US012304764B2

(12) United States Patent
Shimosaka et al.

(10) Patent No.: US 12,304,764 B2
(45) Date of Patent: May 20, 2025

(54) MEDIUM TRANSPORT DEVICE, CONTROL METHOD, AND CONTROL PROGRAM

(71) Applicant: PFU LIMITED, Kahoku (JP)

(72) Inventors: Kiichiro Shimosaka, Kahoku (JP); Sachiko Fudeyasu, Kahoku (JP); Hisashi Ogi, Kahoku (JP)

(73) Assignee: PFU LIMITED, Kahoku (JP)

( * ) Notice: Subject to any disclaimer, the term of this patent is extended or adjusted under 35 U.S.C. 154(b) by 82 days.

(21) Appl. No.: 17/755,918

(22) PCT Filed: Mar. 18, 2020

(86) PCT No.: PCT/JP2020/012114
§ 371 (c)(1),
(2) Date: May 11, 2022

(87) PCT Pub. No.: WO2021/186643
PCT Pub. Date: Sep. 23, 2021

(65) Prior Publication Data

US 2022/0380167 A1 Dec. 1, 2022

(51) Int. Cl.
*B65H 5/34* (2006.01)
*B65H 7/04* (2006.01)
*B65H 43/04* (2006.01)

(52) U.S. Cl.
CPC ..... *B65H 43/04* (2013.01); *B65H 2513/10* (2013.01)

(58) Field of Classification Search
CPC ..... B65H 2513/10; B65H 2513/20; B65H 7/04; B65H 7/06; B65H 7/12; B65H 7/125;
(Continued)

(56) References Cited

U.S. PATENT DOCUMENTS 5,299,795 A * 4/1994 Miyake ..... G03G 15/6502 271/111
7,523,932 B2 * 4/2009 Morisaki ..... B65H 7/06 271/10.03
2005/0074251 A1 4/2005 Katoh et al.
(Continued)

FOREIGN PATENT DOCUMENTS

JP H11-11689 A 1/1999
JP H11-60053 A 3/1999
(Continued)

OTHER PUBLICATIONS

International Search Report of PCT/JP2020/012114, Jun. 2, 2020, 4 pages.
(Continued)

*Primary Examiner* — Luis A Gonzalez
(74) *Attorney, Agent, or Firm* — WOMBLE BOND DICKINSON (US) LLP

(57) ABSTRACT

Provided are a medium conveying apparatus, a control method, and a control program is to enable further reduction in the time required for conveying the medium while suppressing the occurrence of the conveyance abnormality of the medium. A medium conveying apparatus includes a conveying mechanism to convey a medium, a determination module to determine whether a conveyance abnormality of the medium has occurred, and a control module to control the conveying mechanism so as to increase a conveyance speed of the medium to be conveyed thereafter, or reduce a conveyance interval of the medium to be conveyed thereafter if the conveyance abnormality of the medium has not occurred when a predetermined number of medium is conveyed.

15 Claims, 17 Drawing Sheets

(58) Field of Classification Search
CPC ..... B65H 7/18; B65H 7/20; B65H 2511/24; B65H 2511/524; B65H 2511/528; B65H 2511/529; B65H 2511/52; B65H 2515/815; B65H 5/34; B65H 43/04
See application file for complete search history.

(56) References Cited

U.S. PATENT DOCUMENTS

| | | | | |
|---|---|---|---|---|
| 2014/0319755 | A1* | 10/2014 | Alaas ..... | G03G 15/6564 271/110 |
| 2020/0115176 | A1* | 4/2020 | Matsukawa ..... | G03G 15/5079 |
| 2020/0385226 | A1* | 12/2020 | Hishinuma ..... | G03G 15/6567 |

FOREIGN PATENT DOCUMENTS

| | | | | |
|---|---|---|---|---|
| JP | 2000-264445 | A | | 9/2000 |
| JP | 2001-13740 | A | | 1/2001 |
| JP | 2004-061733 | A | | 2/2004 |
| JP | 2010-143695 | A | | 7/2010 |
| JP | 2016-86285 | A | | 5/2016 |
| JP | 2016147746 | A | * | 8/2016 |
| JP | 2019-151439 | A | | 9/2019 |
| JP | 2019-198007 | | | 11/2019 |
| JP | 2019-198007 | A | | 11/2019 |

OTHER PUBLICATIONS

International Search Report dated Jun. 2, 2020 for corresponding PCT Application No. PCT/JP2020/012114 (3 pages) with English Translation (2 pages).

Written Opinion dated Jun. 2, 2020 for corresponding PCT Application No. PCT/JP2020/012114 (3 pages) with English Translation (3 pages).

International Preliminary Report on Patentability dated Sep. 20, 2022 for corresponding PCT Application No. PCT/JP2020/012114 (4 pages) with English Translation (4 pages).

Japanese Office Action dated Dec. 27, 2022 regarding Japanese Patent Application No. 2022-507934 corresponding to U.S. Appl. No. 17/755,918 (2 pages) with English Translation (5 pages).

Japanese Office Action dated Aug. 22, 2023 regarding Japanese Patent Application No. 2023-061411 corresponding to U.S. Appl. No. 17/755,918 (3 pages) with English Translation (5 pages).

Japanese Office Action dated Dec. 12, 2023 regarding Japanese Patent Application No. 2023-061411 corresponding to U.S. Appl. No. 17/755,918 (2 pages) with English Translation (4 pages).

Japanese Office Action dated Apr. 23, 2024 regarding Japanese Patent Application No. 2023-61411 corresponding to U.S. Appl. No. 17/755,918 (4 pages) with English Translation (3 pages).

* cited by examiner

MEDIUM TRANSPORT DEVICE, CONTROL METHOD, AND CONTROL PROGRAM

CROSS-REFERENCE TO RELATED APPLICATION(S)

This application is a U.S. National Phase Patent Application and claims priority to and the benefit of International Application Number PCT/JP2020/012114, filed on Mar. 18, 2020, the entire content of which is incorporated herein by reference.

FIELD

The present disclosure relates to a medium conveying apparatus, a control method, and a control program, and more particularly to a medium conveying apparatus, a control method, and a control program to determine whether a conveyance abnormality of a medium has occurred.

BACKGROUND

A medium conveying apparatus, such as a scanner device, to convey and image a medium, is required to complete a conveying process of the medium in a shorter time. However, in the medium conveying apparatus, if a conveyance speed of the medium is increased too much, a conveyance abnormality, such as a jam, a slip, a multi-feed or a skew of the medium may be likely to occur.

An automatic document feeding apparatus to read an image while moving a document, is disclosed (see Patent Literature 1). The automatic document feeding apparatus detects a document size until the document reaches the read position at least twice after the start of the conveyance, and controls to convey the document at the time of image reading at a predetermined conveyance speed corresponding to the document size.

CITATION LIST

Patent Literature

Patent Literature 1: Japanese Unexamined Patent Publication No. 2001-13740

SUMMARY

It is desired for the medium conveying apparatus to further reduce the time required for conveying the medium while suppressing the occurrence of the conveyance abnormality of the medium.

An object of a medium conveying apparatus, a control method and a control program is to enable further reduction in the time required for conveying the medium while suppressing the occurrence of the conveyance abnormality of the medium.

According to some embodiments, a medium conveying apparatus includes a conveying mechanism to convey a medium, a determination module to determine whether a conveyance abnormality of the medium has occurred, and a control module to control the conveying mechanism so as to increase a conveyance speed of the medium to be conveyed thereafter, or reduce a conveyance interval of the medium to be conveyed thereafter if the conveyance abnormality of the medium has not occurred when a predetermined number of medium is conveyed.

According to some embodiments, a control method of a medium conveying apparatus including a conveying mechanism to convey a medium, includes determining whether a conveyance abnormality of the medium has occurred, and controlling the conveying mechanism so as to increase a conveyance speed of the medium to be conveyed thereafter, or reduce a conveyance interval of the medium to be conveyed thereafter if the conveyance abnormality of the medium has not occurred when a predetermined number of medium is conveyed.

According to some embodiments, a control program of a medium conveying apparatus including a conveying mechanism to convey a medium, causes the medium conveying apparatus to execute determining whether a conveyance abnormality of the medium has occurred, and controlling the conveying mechanism so as to increase a conveyance speed of the medium to be conveyed thereafter, or reduce a conveyance interval of the medium to be conveyed thereafter if the conveyance abnormality of the medium has not occurred when a predetermined number of medium is conveyed.

According to the present embodiment, the medium conveying apparatus, the control method and the control program can further reduce the time required for conveying the medium while suppressing the occurrence of the conveyance abnormality of the medium.

The object and advantages of the invention will be realized and attained by means of the elements and combinations, in particular, described in the claims. It is to be understood that both the foregoing general description and the following detailed description are exemplary and explanatory, and are not restrictive of the invention, as claimed.

DESCRIPTION OF EMBODIMENTS

Hereinafter, a medium conveying apparatus, a control method and a control program according to an embodiment, will be described with reference to the drawings. However, it should be noted that the technical scope of the invention is not limited to these embodiments, and extends to the inventions described in the claims and their equivalents.

Figure 1:
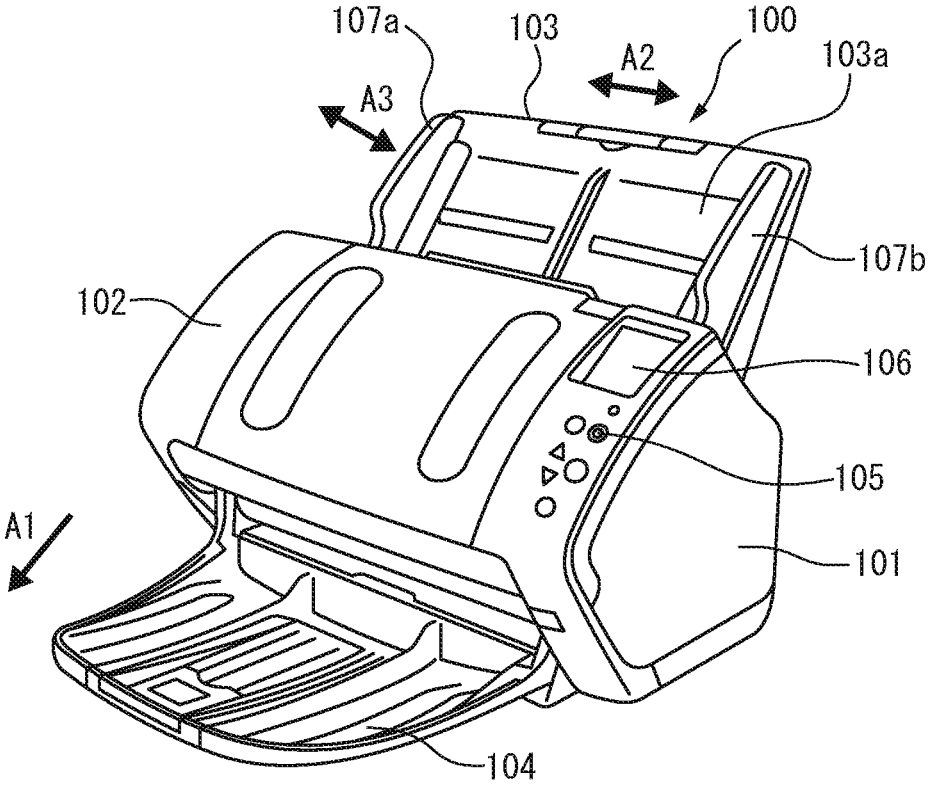
FIG. 1 is a perspective view illustrating a medium conveying apparatus 100 according to the embodiment.

FIG. 1 is a perspective view illustrating a medium conveying apparatus 100 configured as an image scanner. The medium conveying apparatus 100 conveys and images a medium being a document. The medium is a paper, a card, a booklet, etc. The booklet includes a passport or a passbook, etc. The medium conveying apparatus 100 may be a fax machine, a copying machine, a multifunctional peripheral (MFP), etc. A conveyed medium may not be a document but may be an object being printed on etc., and the medium conveying apparatus 100 may be a printer etc.

The medium conveying apparatus 100 includes a lower housing 101, an upper housing 102, a medium tray 103, an ejection tray 104, an operation device 105, and a display device 106. An arrow A1 in FIG. 1 indicates a medium conveying direction. Hereinafter, an upstream refers to an upstream in the medium conveying direction A1, and a downstream refers to a downstream in the medium conveying direction A1.

The upper housing 102 is located at a position covering the upper surface of the medium conveying apparatus 100 and is engaged with the lower housing 101 by hinges so as to be opened and closed at a time of medium jam, during cleaning the inside of the medium conveying apparatus 100, etc.

The medium tray 103 is engaged with the lower housing 101 in such a way as to be able to place a medium to be conveyed. The medium tray 103 has a placing surface 103*a* on which a medium is placed. A first side guide 107*a* and a second side guide 107*b* are provided on the placing surface 103*a*. Hereinafter, the first, second side guides 107*a*, 107*b* may be collectively referred to as the side guides 107. Each of the side guides 107 is movably provided in the width direction A2 perpendicular to the medium conveying direction on the medium tray 103. Each of the side guides 107 has a predetermined height in a height direction A3, and regulates the width direction of the medium placed on the medium tray 103. The ejection tray 104 is engaged with the lower housing 101 in such a way as to be able to hold an ejected medium.

The operation device 105 includes an input device such as a button, and an interface circuit acquiring a signal from the input device, receives an input operation by a user, and outputs an operation signal based on the input operation by the user. The display device 106 includes a display including a liquid crystal or organic electro-luminescence (EL), and an interface circuit for outputting image data to the display, and displays the image data on the display.

Figure 2A:
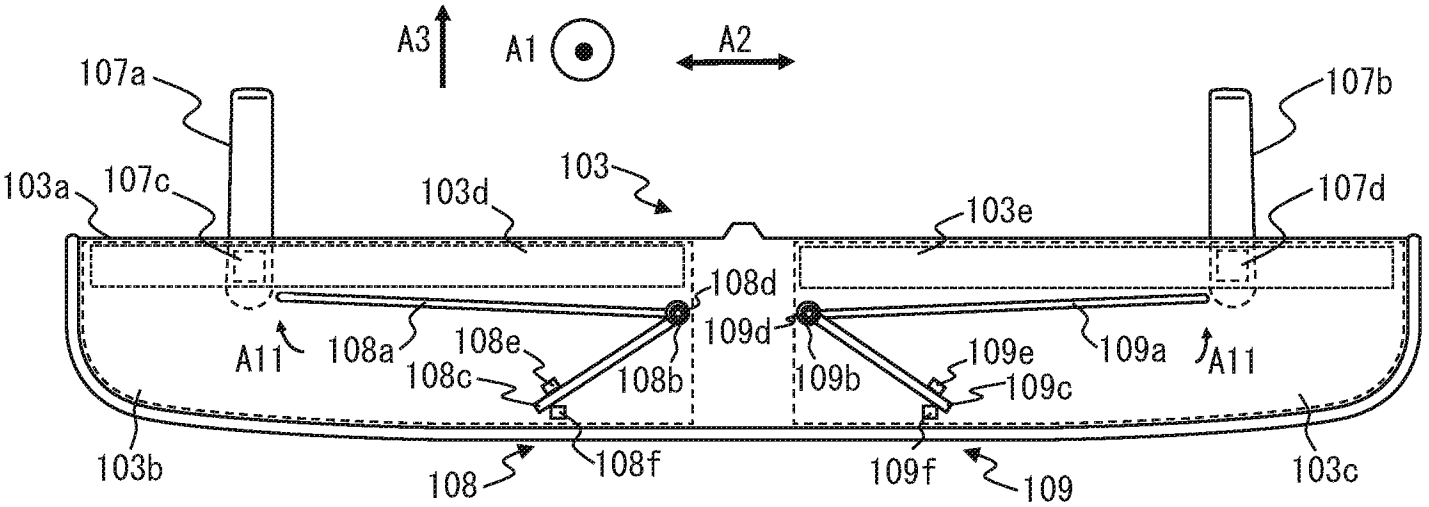
FIG. 2A is a schematic view for illustrating a side guide 107.
Figure 2B:
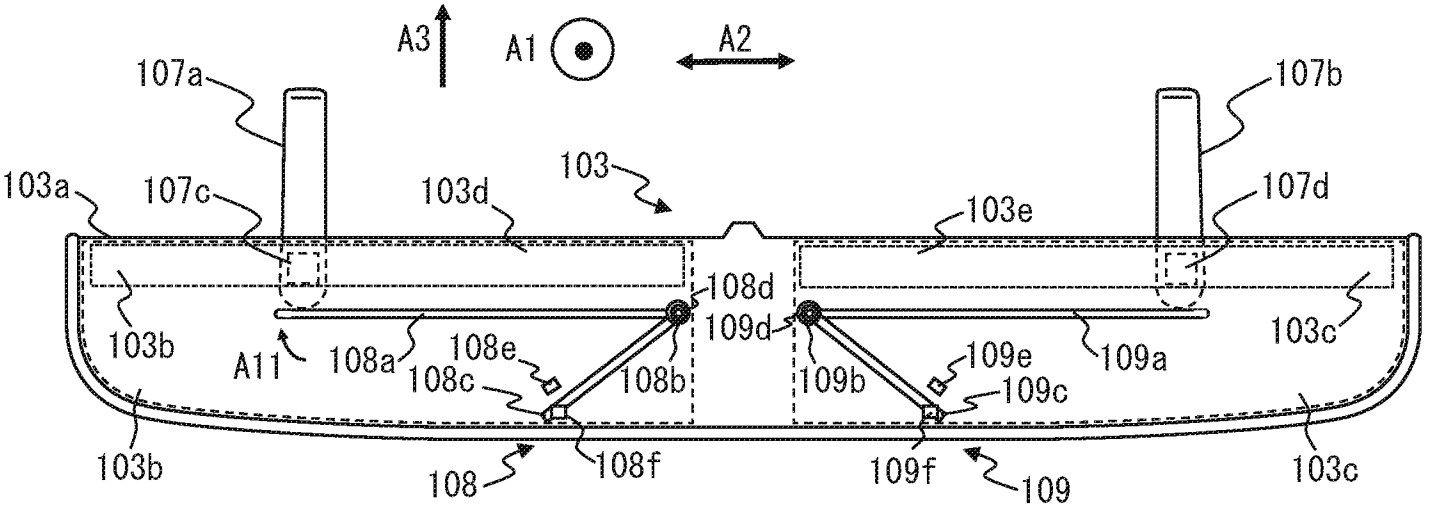
FIG. 2B is a schematic view for illustrating a side guide 107.

FIGS. 2A and 2B are schematic views for illustrating the side guide 107. FIGS. 2A and 2B are side views of the medium tray 103 removed from the lower housing 101, from the downstream side.

As shown in FIGS. 2A and 2B, a first recess 103*b* and a second recess 103*c* extending in the width direction A2, respectively, are formed on the placing surface 103*a* of the medium tray 103. Further, first guide portions 103*d* and second guide portions 103*e* are formed at the upstream end and the downstream end of the first recess 103*b* and the second recess 103*c*. The first guide portions 103*d* and the second guide portions 103*e* are rails formed so as to extend in the width direction A2. On the other hand, first protrusions 107*c* and second protrusions 107*d* are formed at the upstream end and the downstream end of the lower end in the height direction A3 of the first side guide 107*a* and the second side guide 107*b*. Each of the side guides 107 slides in the width direction A2 on the medium tray 103, by the first protrusions 107*c* and the second protrusions 107*d* moving along the first guide portions 103*d* and the second guide portions 103*e*.

Further, the medium tray 103 has a first side guide sensor 108 and the second side guide sensor 109. The first side guide sensor 108 and the second side guide sensor 109 are provided inside the first recess 103*b* and the second recess 103*c*, and on the lower side of the first second side guide 107*a* and the second side guide 107*b* in the height direction A3, respectively. The first side guide sensor 108 includes an arm 108*a*, a support portion 108*b*, a shield portion 108*c*, a torsion coil spring 108*d*, a stopper 108*e* and an optical sensor 108*f*, etc. The second side guide sensor 109 includes an arm 109*a*, a support portion 109*b*, a shield portion 109*c*, a torsion coil spring 109*d*, a stopper 109*e* and an optical sensor 109*f*, etc. Since the structure and the operation of the first side guide sensor 108 and the second side guide sensor 109 are similar, only the structure and the operation of the first side guide sensor 108 will be described below as a representative.

The arm 108*a* is provided so as to be in contact with the first side guide 107*a* when the first side guide 107*a* is located inside the predetermined position (on a center side), and not to be in contact with the first side guide 107*a* when the first side guide 107*a* is located outside the predetermined position. The predetermined position is set between a position at which the first side guide 107*a* being in contact with the medium of a first size placed on the medium tray 103 is located and a position at which the first side guide 107*a* being in contact with the medium of a second size placed on the medium tray 103 is located. For example, the first size is a size of the short side of A5, and the second size is a size of the short side of B6.

The support portion 108*b* is rotatably attached to the medium tray 103. The arm 108*a* and the shield portion 108*c* are supported integrally and swingably (rotatably) by the support portion 108*b* with the support portion 108*b* as a rotation axis. The torsion coil spring 108*d* is provided between the medium tray 103 and the arm 108*a*. The torsion coil spring 108*d* is provided around the support portion 108*b* so that a force is applied to the arm 108*a* in a direction of an arrow A11 (upward in the height direction A3). The medium tray 103 is provided with the stopper 108*e* to stop the shield portion 108*c*.

The optical sensor 108*f* includes a light emitter and a light receiver located facing each other. The light emitter emits light toward light receiver. The light receiver receives the light emitted by the light emitter, and outputs a first side guide signal which is an electrical signal corresponding to the intensity of the received light. When the shield portion 108*c* exists between the light emitter and the light receiver, the light emitted by the light emitter is shielded by the shield portion 108*c*. Therefore, the signal value of the first side guide signal changes corresponding to the position of the shield portion 108*c*, that is, corresponding to the movement amount of the arm 108*a* that moves together with the shield portion 108*c*.

As shown in FIG. 2A, when located outside the predetermined position, the first side guides 107*a* is not in contact with the arm 108*a*. In this state, the shield portion 108*c* is pushed upward by the arm 108*a* pushed upward by the torsion coil spring 108*d*, abuts against the stopper 108*e*, and stops. As a result, the shield portion 108*c* does not exist between the light emitter and the light receiver, and the signal value of the first side guide signal indicates a state in which the first side guide 107*a* exists outside the predetermined position. On the other hand, as shown in FIG. 2B, when located inside the predetermined position, the first side guide 107*a* is in contact with the arm 108*a*. In this state, the arm 108*a* is pushed down in a direction opposite to the arrow A11 by the first side guide 107*a*, and the shield portion 108*c* is moved downward by the arm 108*a*. As a result, the shield portion 108*c* is located between the light emitter and the light receiver, and the signal value of the first side guide signal indicates a state in which the first side guide 107*a* exists inside the predetermined position.

Similarly, the optical sensor 109*f* generates and outputs a second side guide signal indicating whether the second side guide 107*b* exists inside the predetermined position or outside the predetermined position.

The first side guide sensor 108 and the second side guide sensor 109 can appropriately detect the position of the side guide without using a special sensor having a complex structure, by using the optical sensor. Therefore, the medium conveying apparatus 100 can appropriately detect the position of the side guide 107 while suppressing an increase in the apparatus cost or apparatus weight.

The first side guide sensor 108 and the second side guide sensor 109 may be provided inside the lower housing 101, rather than the medium tray 103. In that case, the surfaces of the medium tray 103 and the lower housing 101 facing each other are provided with hole portions, and a projection extending toward the downstream side in the medium conveying direction A1 to the inside of the lower housing 101 through the hole portions is provided on the lower end in the height direction A3 of the side guide 107. The arms 108*a* and 109*a* are provided so as to be in contact with the projections of the side guides 107 when the side guides 107 are located inside the predetermined position, and not to be in contact with the projections of the side guides 107 when the side guides 107 are located outside the predetermined position, respectively. By the first side guide sensor 108 and the second side guide sensor 109 provided inside the lower housing 101, the medium tray 103 is detachable from the lower housing 101 without considering the electrical wiring between the optical sensors 108*f* and 109*f*, and the processing circuit to be described later.

The medium conveying apparatus 100 may detect the position of the side guide 107, by using a push button, instead of the optical sensors 108*f* and 109*f*. The push buttons are located so that they are not in contact with the shield portions 108*c* and 109*c* in a state in which the side guides 107 are located outside the predetermined position, and they are in contact with the shield portions 108*c* and 109*c* to be pressed in a state in which the side guides 107 are located inside the predetermined position. The push buttons, respectively, generate and output a first side guide signal and a second side guide signal of which the signal value is different depending on whether or not the push buttons are pressed.

Further, the medium conveying apparatus 100 may detect the position at which the side guides 107 are located, by using a distance sensor, instead of the first side guide sensor 108 and the second side guide sensor 109. In that case, a plurality of distance sensors are located on the upper guide 110*b*, on the upstream side of the feed roller 113 and the brake roller 114, and apart from each other along in the width direction A2. Each of the distance sensors is an infrared access distance sensor and measures a distance from an object existing at a facing position, based on a time difference between emission and reflection of infrared rays. Each of the distance sensors includes a light emitter and a light receiver. The light emitter emits light (infrared light) toward the placing surface 103*a* of the medium tray 103. On the other hand, the light receiver receives light emitted by the corresponding light emitter and reflected by the placing surface 103*a* or the side guide 107 of the medium tray 103, and generates an electric signal corresponding to the received light.

The generated signal indicates a time from when the light emitter emits light to when the light receiver receives light, and a light amount of light received by the light receiver. Therefore, the generated signal changes depending on whether a position at which the light emitted by the light emitter is reflected is the placing surface 103*a* or the side guide 107, that is, depending on whether the side guide 107 is located at a position facing the light emitter. Therefore, the medium conveying apparatus 100 can detect the position at which the side guide 107 is located, based on the electric signal generated by each of the distance sensors.

Figure 3:
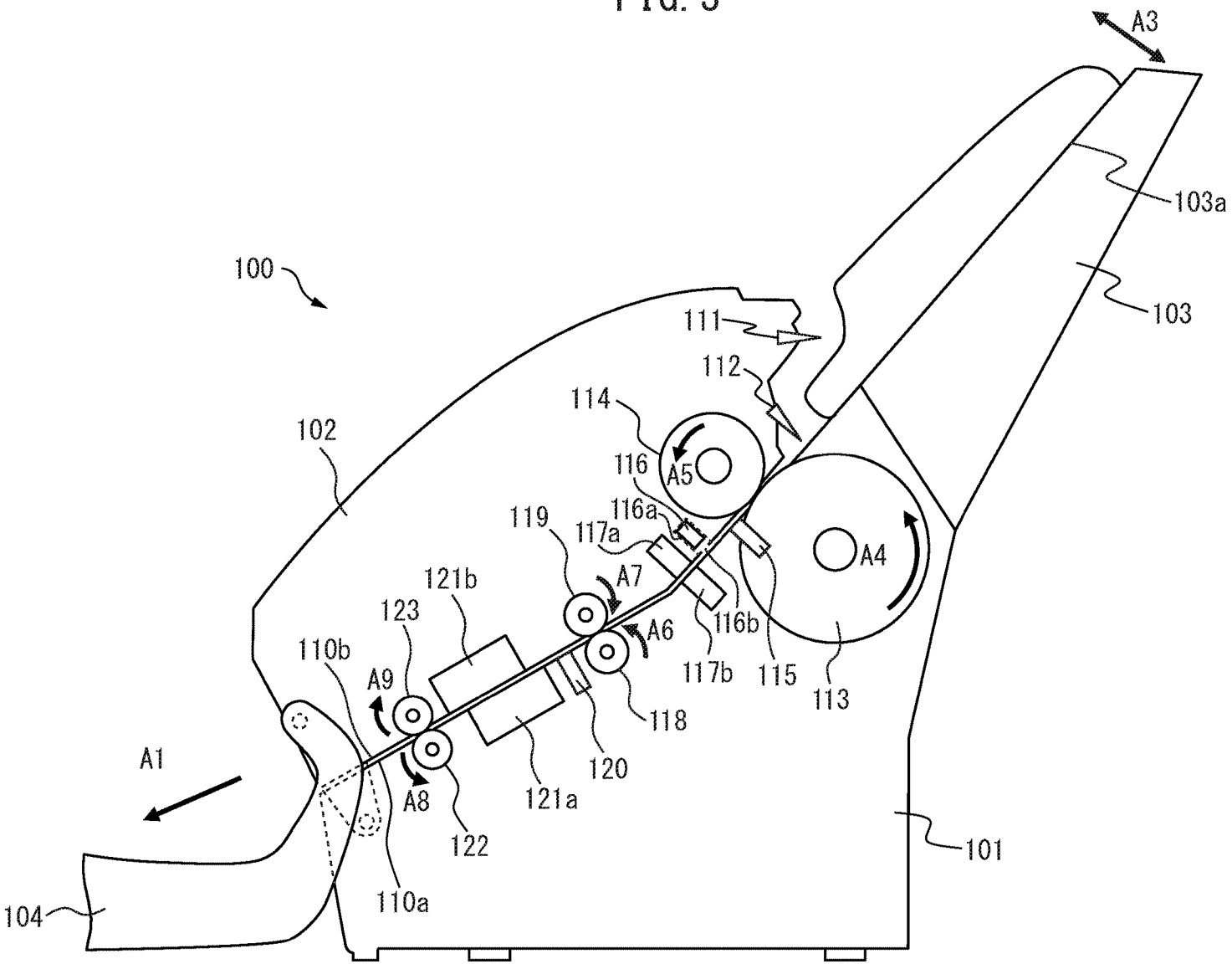
FIG. 3 is a diagram for illustrating a conveyance path inside the medium conveying apparatus 100.

FIG. 3 is a diagram for illustrating a conveyance path inside the medium conveying apparatus 100.

The conveyance path inside the medium conveying apparatus 100 includes a first medium sensor 111, a second medium sensor 112, a feed roller 113, a brake roller 114, a third medium sensor 115, a microphone 116, an ultrasonic transmitter 117*a*, an ultrasonic receiver 117*b*, a first conveyance roller 118, a second conveyance roller 119, a fourth medium sensor 120, a first imaging device 121*a*, a second imaging device 121*b*, a third conveyance roller 122 and a fourth conveyance roller 123, etc. The number of each roller is not limited to one, and may be plural. Hereinafter, the first imaging device 121*a* and the second imaging device 121*b* may be collectively referred to as imaging devices 121.

A top surface of the lower housing 101 forms a lower guide 110*a* of a conveyance path of a medium, and a bottom surface of the upper housing 102 forms an upper guide 110*b* of the conveyance path of a medium.

The second medium sensor 112 is located on the downstream side of the first medium sensor 111 and on the upstream side of the feed roller 113 and the brake roller 114. The second medium sensor 112 includes a contact detection sensor, and detects whether or not the medium is placed on the medium tray 103. The second medium sensor 112 generates and outputs a second medium signal of which the signal value changes between a state in which a medium is placed on the medium tray 103 and a state in which a medium is not placed.

The feed roller 113 is provided on the lower housing 101 and sequentially feed media placed on the medium tray 103 from the lower side. The brake roller 114 is provided in the upper housing 102 and is located to face the feed roller 113.

The third medium sensor 115 is located on the downstream side of the feed roller 113 and the brake roller 114 and on the upstream side of the first conveyance roller 118 and the second conveyance roller 119, to detect whether or not the medium exists at the position. The third medium sensor 115 includes a light emitter and a light receiver provided on one side with respect to the conveyance path of the medium, and a reflection member such as a mirror provided at a position facing the light emitter and the light receiver across the conveyance path. The light emitter emits light toward the conveyance path. On the other hand, the light receiver receives light emitted by the light emitter and reflected by the reflection member, and generates and outputs a third medium signal being an electric signal corresponding to the intensity of the received light. Since the light emitted by the light emitter is shielded by the medium when the medium exists at the position of the third medium sensor 115, the signal value of the third medium signal is changed in a state in which the medium exists at the position of the third medium sensor 115 and a state in which a medium does not exist at the position. The light emitter and the light receiver may be provided at positions facing one another with the conveyance path in between, and the reflection member may be omitted.

The microphone 116 is provided near the medium conveyance path, receives (collects) a sound (audible sound) generated during conveyance of a medium, and generates and outputs an analog sound signal corresponding to the received sound. The microphone 116 is located on the downstream side of the feed roller 113 and the brake roller 114 and on the upstream side of the first conveyance roller 118 and the second conveyance roller 119, and fixed to a frame 116*a* inside the upper housing 102. The upper guide 110*b* has a hole 116*b* at the position facing the microphone 116 so that the microphone 116 can collect a sound produced during conveyance of a medium more accurately.

The ultrasonic transmitter 117*a* and the ultrasonic receiver 117*b* are located on the downstream side of the feed roller 113 and the brake roller 114 and on the upstream side of the first conveyance roller 118 and the second conveyance roller 119. The ultrasonic transmitter 117*a* and the ultrasonic receiver 117*b* are located close to the conveyance path of a medium in such a way as to face one another with the conveyance path in between. The ultrasonic transmitter 117*a* is capable of outputting an ultrasonic wave. On the other hand, the ultrasonic receiver 117*b* receives an ultrasonic wave being transmitted by the ultrasonic transmitter 117*a* and passing through a medium, and generates and outputs an ultrasonic signal being an electric signal corresponding to the received ultrasonic wave. Hereinafter, the ultrasonic transmitter 117*a* and the ultrasonic receiver 117*b* may be collectively referred to as an ultrasonic sensor 117.

The first conveyance roller 118 and the second conveyance roller 119 are located on the downstream side of the feed roller 113 and the brake roller 114 and on the upstream side of the imaging device 121.

The fourth medium sensor 120 is located on the downstream side of the first conveyance roller 118 and the second conveyance roller 119 and on the upstream side of the imaging device 121, and in a substantially central portion in the width direction A2, to detect whether or not the medium exists at the position. The fourth medium sensor 120 includes a light emitter and a light receiver provided on one side with respect to the conveyance path of the medium, and a reflection member such as a mirror provided at a position facing the light emitter and the light receiver across the conveyance path. The light emitter emits light toward the conveyance path. On the other hand, the light receiver receives light emitted by the light emitter and reflected by the reflection member and outputs a fourth medium signal which is an electric signal corresponding to the intensity of the received light. Since the light emitted by the light emitter is shielded by the medium when the medium exists at the position of the fourth medium sensor 120, the signal value of the fourth medium signal is changed in a state in which the medium exists at the position of the fourth medium sensor 120 and a state in which a medium does not exist at the position. The light emitter and the light receiver may be provided at positions facing one another with the conveyance path in between, and the reflection member may be omitted.

The first imaging device 121*a* is located on the downstream side of the first conveyance roller 118 and the second conveyance roller 119. The first imaging device 121*a* includes a line sensor based on a unity-magnification optical system type contact image sensor (CIS) including an imaging element based on a complementary metal oxide semiconductor (CMOS) linearly located in a main scanning direction. The first imaging device 121*a* includes a light source to irradiate light toward the conveyed medium, a lens for forming an image on the imaging element, and an A/D converter for amplifying and analog-digital (A/D) converting an electric signal output from the imaging element. The first imaging device 121*a* sequentially generates and outputs line images acquired by imaging an area of a front surface of the conveyed medium facing the line sensor at certain intervals. Specifically, a pixel count of a line image in a vertical direction (subscanning direction) is 1, and a pixel count in a horizontal direction (main scanning direction) is larger than 1.

Similarly, the second imaging device 121*b* is located on the downstream side of the first conveyance roller 118 and the second conveyance roller 119. The second imaging device 121*b* includes a line sensor based on a unity-magnification optical system type CIS including an imaging element based on a CMOS linearly located in a main scanning direction. Further, the second imaging device 121*b* includes a light source to irradiate light toward the conveyed medium, a lens for forming an image on the imaging element, and an A/D converter for amplifying and analog-digital (A/D) converting an electric signal output from the imaging element. The second imaging device 121*b* sequentially generates and outputs line images acquired by imaging an area of a back surface of the conveyed medium facing the line sensor at certain intervals.

Only either of the first imaging device 121*a* and the second imaging device 121*b* may be located in the medium conveying apparatus 100 and only one side of a medium may be read. Further, a line sensor based on a unity-magnification optical system type CIS including an imaging element based on charge coupled devices (CCDs) may be used in place of the line sensor based on a unity-magnification optical system type CIS including an imaging element based on a CMOS. Further, a line sensor based on a reduction optical system type line sensor including an imaging element based on CMOS or CCDs.

A medium placed on the medium tray 103 is conveyed between the lower guide 110*a* and the upper guide 110*b* in the medium conveying direction A1 by the feed roller 113 rotating in a direction of an arrow A4 in FIG. 3. When a medium is conveyed, the brake roller 113 rotate in a direction of an arrow A3. By the workings of the feed roller 113 and the brake roller 114, when a plurality of media are placed on the medium tray 103, only a medium in contact with the feed roller 113, out of the media placed on the medium tray 103, is separated. Consequently, the medium conveying apparatus 100 operates in such a way that conveyance of a medium other than the separated medium is restricted (prevention of multi-feed). The feed roller 113 and the brake roller 114 function as a separation mechanism to separate the media.

The medium is fed between the first conveyance roller 118 and the second conveyance roller 119 while being guided by the lower guide 110*a* and the upper guide 110*b*. The medium is fed between the first imaging device 121*a* and the second imaging device 121*b* by the first conveyance roller 118 and the second conveyance roller 119 rotating in directions of an arrow A6 and arrow A7, respectively. The medium read by the imaging device 121 is ejected on the ejection tray 104 by the third conveyance roller 122 and the fourth conveyance roller 123 rotating in directions of an arrow A8 and an arrow A9, respectively. The feed roller 113, the brake roller 114, the first conveyance roller 118, the second conveyance roller 119, the third conveyance roller 122 and the fourth conveyance roller 123 is an example of a conveying mechanism to convey the medium.

Figure 4:
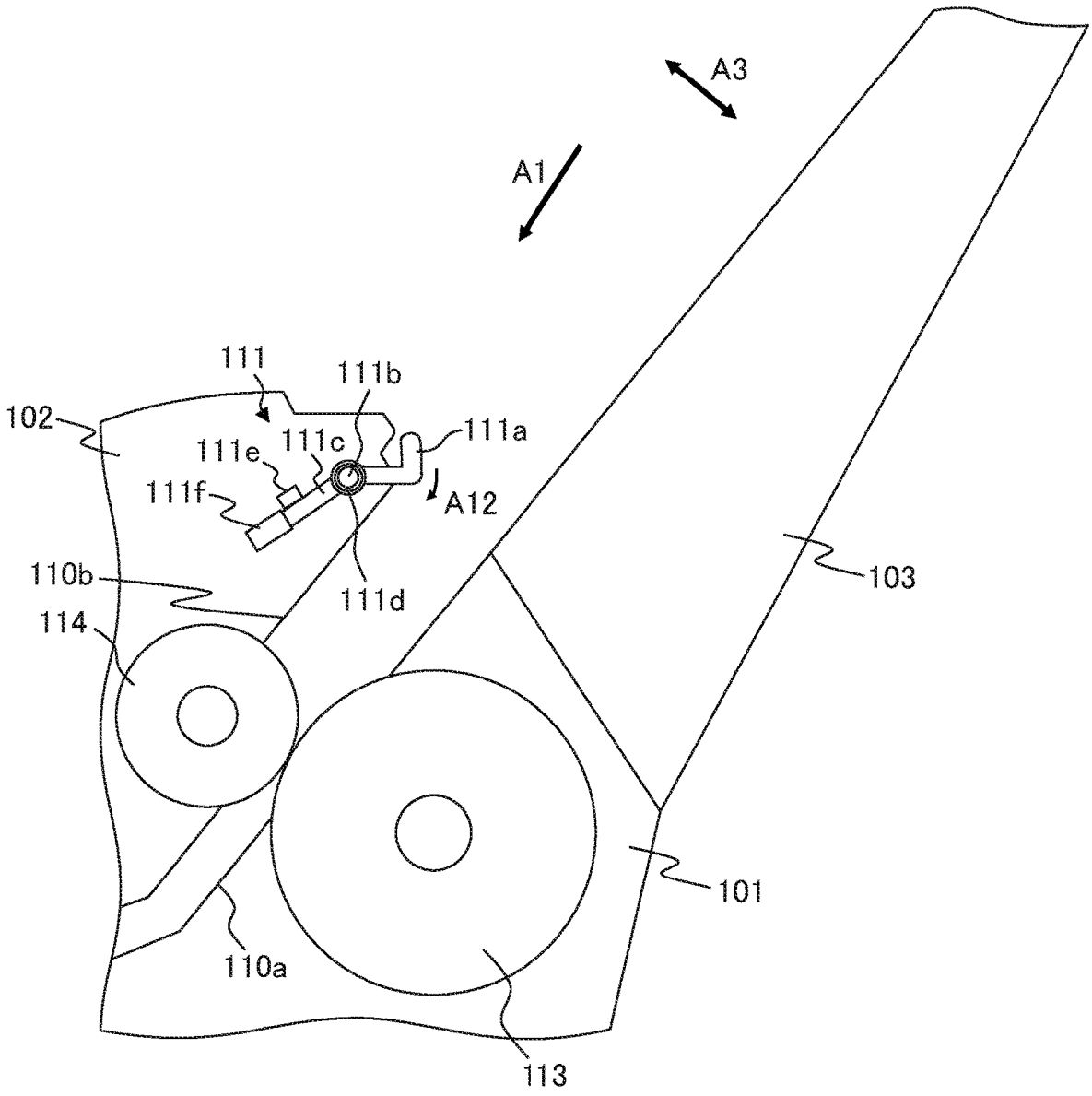
FIG. 4 is a schematic view for illustrating a first medium sensor 111.

FIG. 4 is a schematic diagram for illustrating the first medium sensor 111. FIG. 4 is a schematic view of an upstream side of the medium conveying apparatus 100 viewed from a side.

The first medium sensor 111 is located on the upper guide 110*b*, on the upstream side of the feed roller 113 and the brake roller 114, and in a central portion of the upper housing 102 in the width direction A2. The first medium sensor 111 includes an arm 111*a*, a support portion 111*b*, a shield portion 111*c*, a torsion coil spring 111*d*, a stopper 111*e*, an optical sensor 111*f*, etc.

The arm 111*a* is provided on the upper guide 110*b* and on the upstream side of the feed roller 113 and the brake roller 114 so as to be able to be in contact with the medium to be fed. The support portion 111*b* is rotatably attached to the upper housing 102. The arm 111*a* and the shield portion 111*c* are supported integrally and swingably (rotatably) by the support portion 111*b* with the support portion 111*b* as a rotation axis. The torsion coil spring 111*d* is provided between the upper housing 102 and the arm 111*a*. The torsion coil spring 111*d* is provided around the support portion 111*b* so that a force is applied to the arm 111*a* in a direction of the arrow A12 (downward in the height direction A3). The stopper 111*e* is provided so as to stop the shield portion 111*c*.

The optical sensor 111*f* includes a light emitter and a light receiver located facing each other. The light emitter emits light toward the light receiver. The light receiver receives the light emitted by the light emitter, and generates and outputs a first medium signal being an electrical signal corresponding to the intensity of the received light. When the shield portion 111*c* exists between the light emitter and the light receiver, the light emitted by the light emitter is shielded by the shield portion 111*c*. Therefore, the signal value of the first medium signal changes corresponding to the position of the shield portion 111*c*, that is, corresponding to the movement amount of the arm 111*a* that moves together with the shield portion 111*c*.

In a state in which the medium placed on the medium tray 103 is not in contact with the arm 111*a*, the shield portion 111*c* is pushed upward by the arm 111*a* pushed downward by the torsion coil spring 111*d*, abuts against the stopper 111*e*, and stops. As a result, the shield portion 111*c* is located between the light emitter and the light receiver, and the signal value of the first medium signal indicates a state in which the arm 111*a* exists in an initial position shown in FIG. 4. On the other hand, when the medium placed on the medium tray 103 bends and comes into contact with the arm 111*a*, the arm 111*a* is pushed up in a direction opposite to the arrow A12 by the bent medium, and the shield portion 111*c* moves downward by the arm 111*a*. As a result, the shield portion 111*c* does not exist between the light emitter and the light receiver, and the signal value of the first medium signal indicates a state in which the arm 111*a* does not exist in the initial position.

Figure 5:
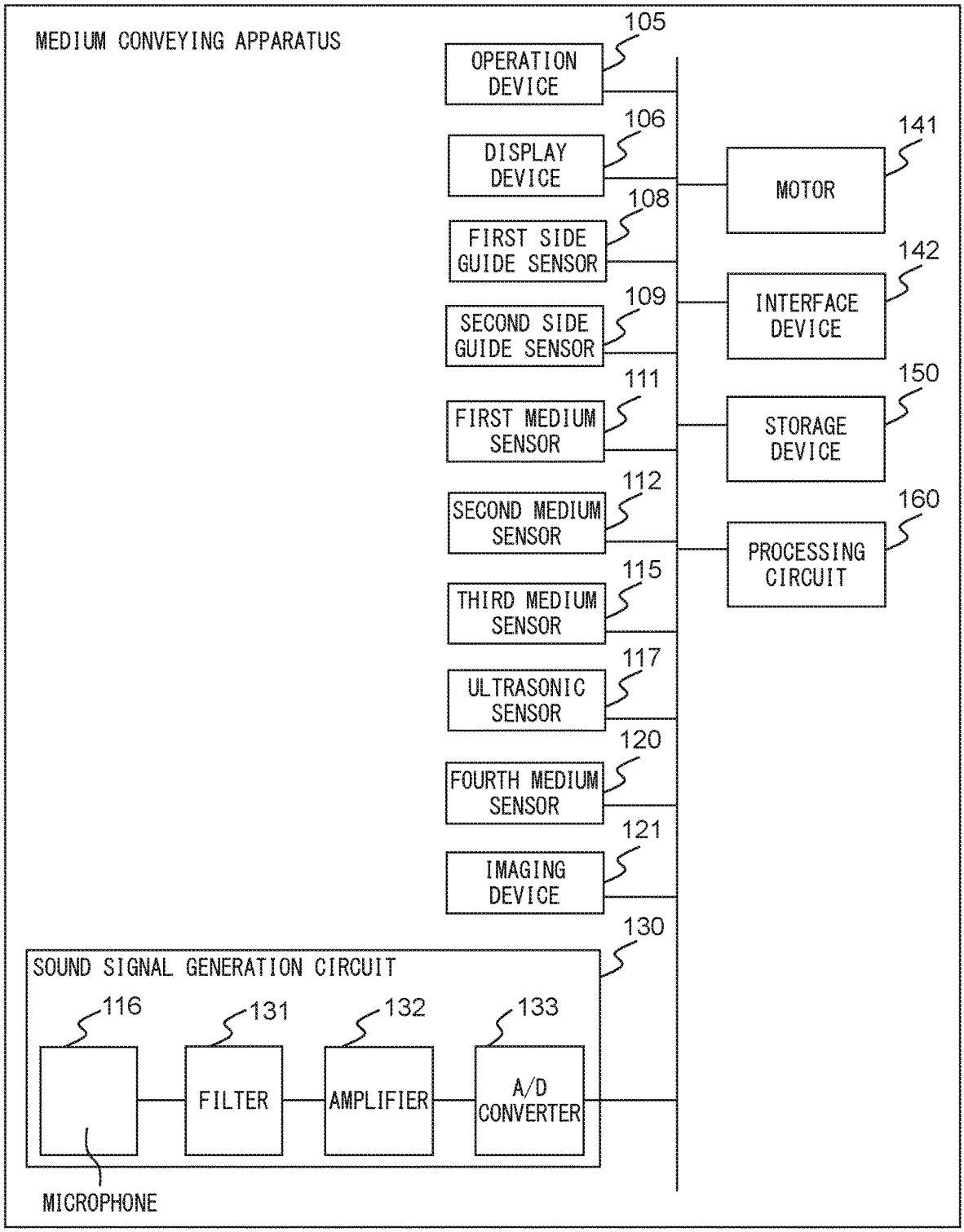
FIG. 5 is a block diagram illustrating a schematic configuration of the medium conveying apparatus 100.

FIG. 5 is a block diagram illustrating a schematic configuration of the medium conveying apparatus 100.

The medium conveying apparatus 100 further includes a sound signal generation circuit 130, a motor 141, an interface device 142, a storage device 150, a processing circuit 160, etc., in addition to the configuration described above.

The sound signal generation circuit 130 includes a filter 131, an amplifier 132, an A/D converter 133, etc., in addition to the microphone 116. The filter 131 applies a band-pass filter, which transmits a signal having a frequency in a predetermined band, to the analog sound signal outputted from the microphone 116, and outputs it to the amplifier 132. The amplifier 132 amplifies the signal outputted from the filter 131, and outputs it to the A/D converter 133. The A/D converter 133 samples the signal outputted from the amplifier 132 at predetermined intervals to generate a digital sound signal, and outputs it to the processing circuit 160. The filter 131, the amplifier 132, and/or the A/D converter 133 may be included in the microphone 116; and the microphone 116 may output a digital sound signal.

The motor 141 includes one or more motors to rotate the feed roller 113, the brake roller 114, and the first to fourth conveyance rollers 118, 119, 122 and 123 to convey the medium by a control signal from the processing circuit 160.

For example, the interface device 142 includes an interface circuit conforming to a serial bus such as universal serial bus (USB), is electrically connected to an unillustrated information processing device, and transmits and receives an input image and various types of information. Further, a communication module including an antenna transmitting and receiving wireless signals, and a wireless communication interface device for transmitting and receiving signals through a wireless communication line in conformance with a predetermined communication protocol may be used in place of the interface device 142. For example, the predetermined communication protocol is a wireless local area network (LAN).

The memory device 150 includes a memory device such as a random access memory (RAM) or a read only memory (ROM), a fixed disk device such as a hard disk, or a portable storage device such as a flexible disk or an optical disk. Further, the memory device 150 stores a computer program, a database, a table, and the like used for various types of processing in the medium conveying apparatus 100. The computer program may be installed on the storage device 150 from a computer-readable, non-transitory medium such as a compact disc read only memory (CD-ROM), a digital versatile disc read only memory (DVD-ROM), etc., by using a well-known setup program, etc.

The processing circuit 160 operates in accordance with a program previously stored in the storage device 150. The processing circuit 160 is, for example, a CPU (Central Processing Unit). The processing circuit 160 may be a digital signal processor (DSP), a large scale integration (LSI), an application specific integrated circuit (ASIC), a field-programmable gate array (FPGA), etc.

The processing circuit 160 is connected to the operation device 105, the display device 106, the first side guide sensor 108, the second side guide sensor 109, the first medium sensor 111, the second medium sensor 112, the third medium sensor 115, the ultrasonic sensor 117, the fourth medium sensor 120, the imaging device 121, the sound signal generation circuit 130, the motor 141, the interface device 142 and the storage device 150, etc., and controls these respective units. The processing circuit 160 performs drive control of the motor 141, imaging control of the imaging device 121, etc., generates an input image, and transmits the input image to the information processing apparatus via the interface device 142. Further, the processing circuit 160 determines whether or not the conveyance abnormality of the medium has occurred based on the output signal from each sensor and the line image from the imaging device 121, etc.

Figure 6:
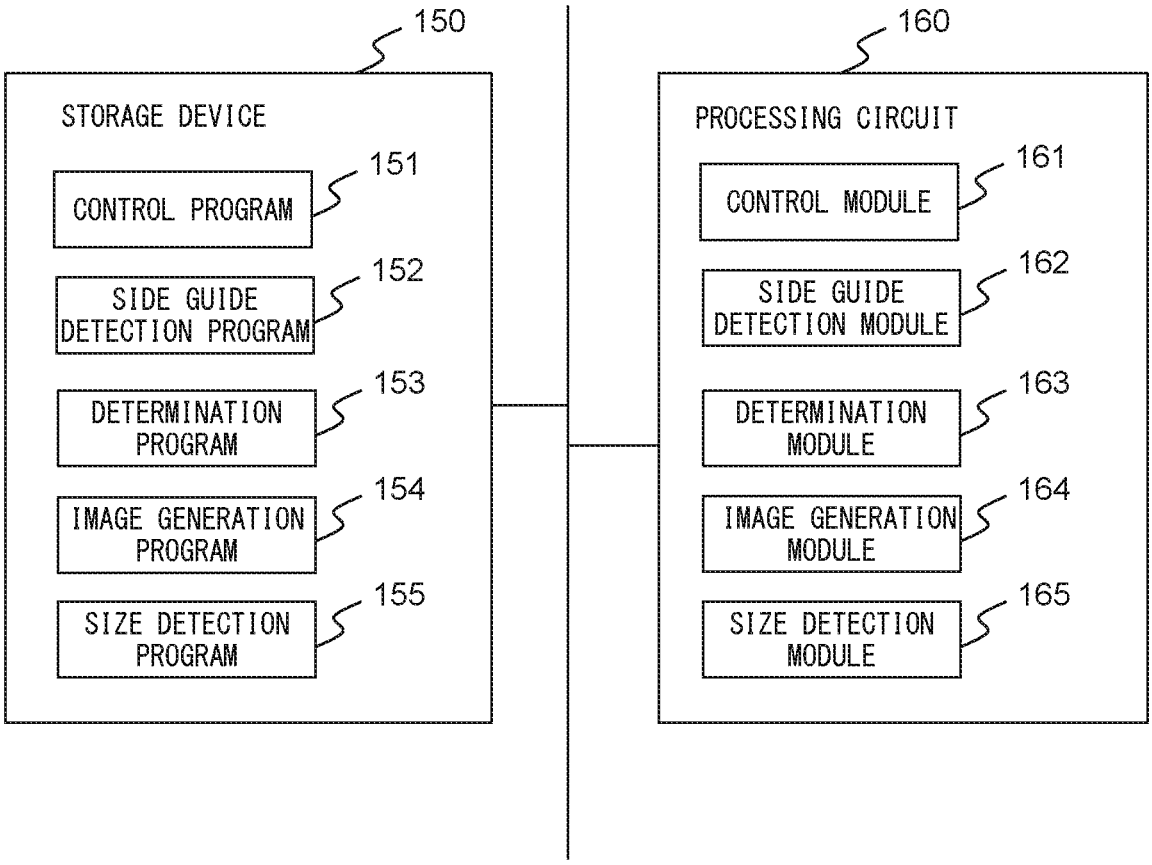
FIG. 6 is a diagram illustrating schematic configurations of a storage device 150 and a processing circuit 160.

FIG. 6 is a diagram illustrating schematic configurations of the storage device 150 and the processing circuit 160.

As shown in FIG. 6, a control program 151, a side guide detection program 152, a determination program 153, an image generation program 154 and a size detection program 155, etc., are stored in the storage device 150. Each of these programs is a functional module implemented by software operating on a processor. The processing circuit 160 reads each program stored in the storage device 150 and operates in accordance with each read program. Thus, the processing circuit 160 functions as a control module 161, a side guide detection module 162, a determination module 163, an image generation module 164 and a size detection module 165.

Figure 7:
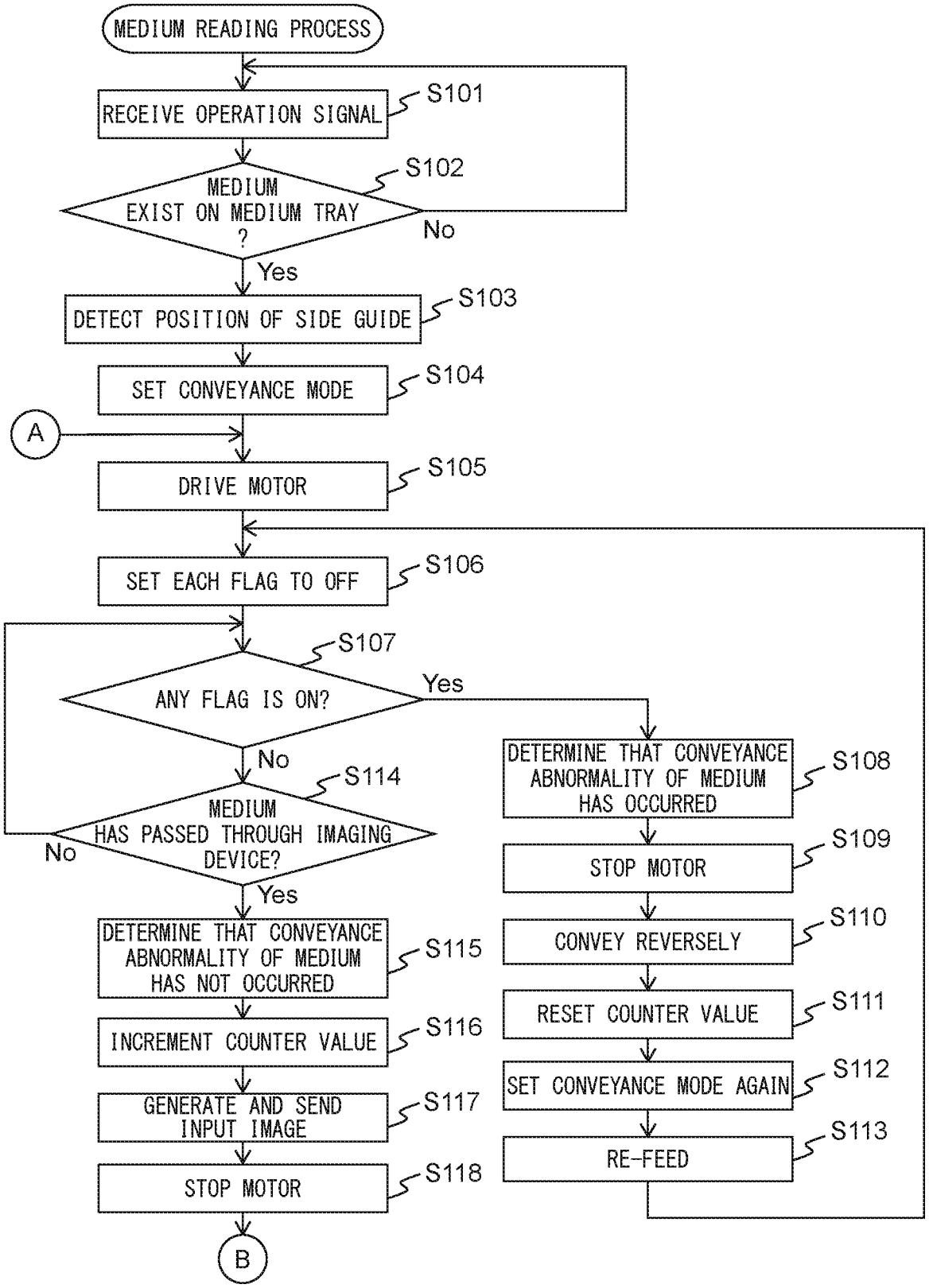
FIG. 7 is a flowchart illustrating an operation example of the medium reading process.
Figure 8:
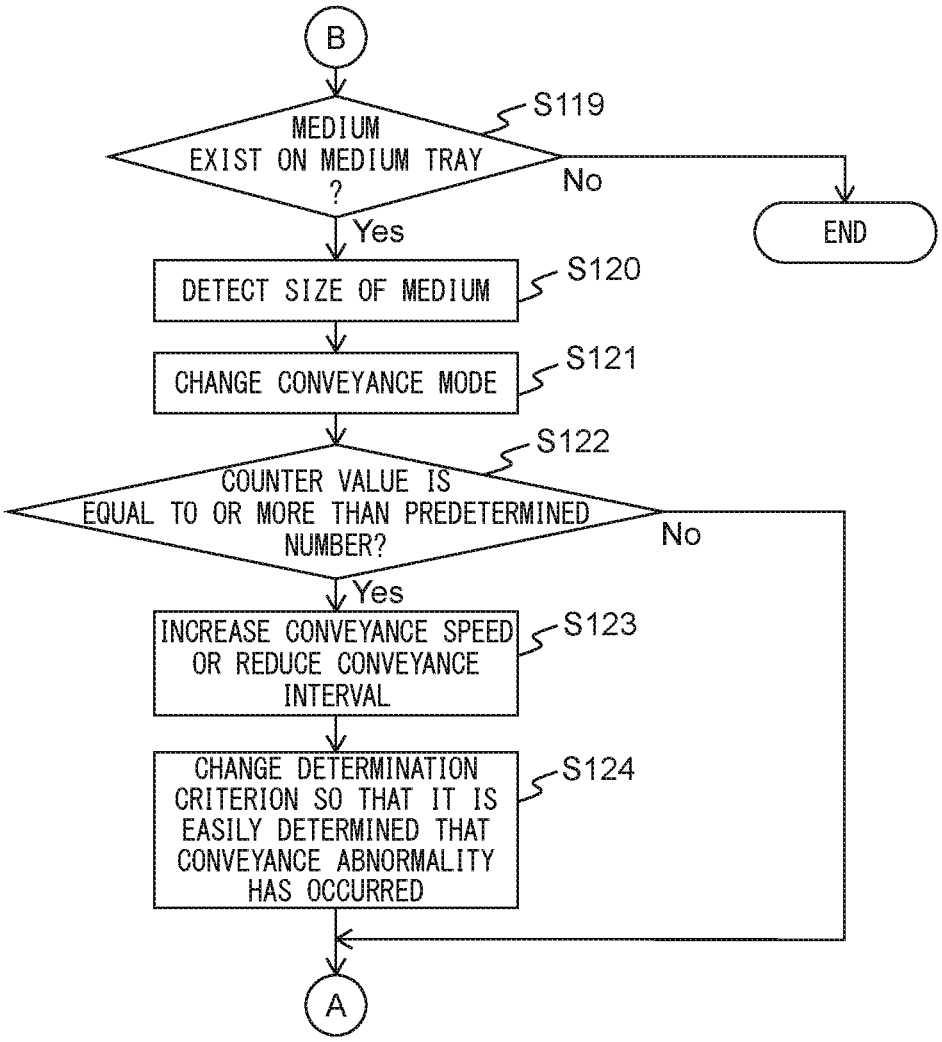
FIG. 8 is a flowchart illustrating an operation example of the medium reading process.

FIGS. 7 and 8 are flowcharts illustrating an operation example of the medium reading process in the medium conveying apparatus 100.

Referring to the flowchart illustrated in FIGS. 7 and 8, the operation example of the medium reading process in the medium conveying apparatus 100 will be described below. The operation flow described below is executed mainly by the processing circuit 160 in cooperation with each element in the medium conveying apparatus 100, in accordance with a program previously stored in the storage device 150. The flow of operations shown in FIGS. 7 and 8 is performed periodically. Further, before the flow of the operation shown in FIGS. 7 and 8 is executed, a counter value for counting the number of the media conveyed without occurring the conveyance abnormality is set to an initial value.

First, the control module 161 stands by until an instruction to read a medium is input by a user by use of the operation device 105, and an operation signal instructing to read the medium is received from the operation device 105 (step S101).

Next, the control module 161 acquires the second medium signal from the second medium sensor 112, and determines whether or not the medium is placed on the medium tray 103, based on the acquired second medium signal (step S102).

When a medium is not placed on the medium tray 103, the control module 161 returns the processing to step S101 and stands by until newly receiving an operation signal from the operation device 105.

On the other hand, when the medium is placed on the medium tray 103, the side guide detection module 162 detects a position at which the side guide 107 is located (step S103). The side guide detection module 162 acquires the first side guide signal from the first side guide sensor 108, and determines whether or not the first side guide 107*a* exists inside the predetermined position or outside the predetermined position, based on the acquired first side guide signal. Further, the side guide detection module 162 acquires the second side guide signal from the second side guide sensor 109, and determines whether or not the second side guide 107*b* exists inside the predetermined position or outside the predetermined position, based on the acquired second side guide signal.

Next, the control module 161 sets the conveyance mode for conveying the medium, according to the position at which the side guide 107 is located, which is detected by the side guide detection module 162 (step S104). When the side guide 107 exists outside the predetermined position, the control module 161 sets the conveyance mode to a normal mode for conveying a medium of a normal size of A5 size or more. On the other hand, when the side guide 107 exists inside the predetermined position, the control module 161 sets a high-speed mode for conveying a small medium of B6 size or less.

The parameters included in the conveyance mode include a conveyance speed of the medium, a conveyance interval of the medium, an ejection speed of the medium, and/or a determination criterion for the conveyance abnormality of the medium by the determination module 163. In general, when conveying the small medium, the conveyance abnormality of the medium is less likely to occur, as compared with the case of conveying the medium of the normal size. Therefore, in the high-speed mode for conveying the small medium, each parameter is set so that the medium can be conveyed at a high speed, as compared with the normal mode for conveying the medium of the normal size.

The conveyance speed of the medium is a rotation speed of the feed roller 113, the brake roller 114, and the first to fourth conveyance rollers 118, 119, 122 and 123. The conveyance speed in the high-speed mode is set to a higher (faster) speed than the conveyance speed in the normal mode. The conveyance interval of the medium is a time from the completion of the conveyance of the current medium to the start of the feeding of the next medium. The conveyance interval in the high-speed mode is set to a time shorter than the conveyance interval in the normal mode. The ejection speed of the medium is the rotation speed of the third and fourth conveyance rollers 122 and 123 immediately before ejecting the medium. The small medium is more likely to scatter during ejection, as compared with the medium of the normal size. To avoid scattering of the small medium during ejection, the conveyance speed in the high-speed mode is set to a lower (slower) speed than the conveyance speed in the normal mode.

The conveyance abnormality of the medium includes a jam, a slip, a multi-feed and/or a skew, etc., of the medium. Since the medium is conveyed at a high speed in the high-speed mode, the medium conveying apparatus 100 is desired to stop the conveyance of the medium earlier so that the medium is not damaged when the conveyance abnormality of the medium has occurred in the high-speed mode. Therefore, the determination criterion for the conveyance abnormality of the medium in the high-speed mode is set so that it is easy to be determined that the conveyance abnormality of the medium has occurred, as compared with the determination criterion for the conveyance abnormality of the medium in the normal mode.

For example, as the determination criterion for the jam of the medium in the normal mode, it is set that the state in which the arm 111*a* does not exist at the initial position continues for a first jam time or longer. On the other hand, as the determination criterion for the jam of the medium in the high-speed mode, it is set that the state in which the arm 111*a* does not exist at the initial position continues for a second jam time or longer. The second jam time is shorter than the first jam time. The first jam time and the second jam time are preset based on a time that the medium continues to bend when the jam of the medium has occurred in an experiment in which various types of media are conveyed. In general, as the size of the medium is smaller, the stiffness of the medium tends to be weaker, and the jam of the medium is likely to occur. The medium conveying apparatus 100 can suppress damage to the small medium by setting the determination criterion for the jam of the medium in the high-speed mode, which is set at the time of conveying the small medium with weak stiffness, so that it is easy to be determined that the jam has occurred.

Further, as the determination criterion for the slip of the medium in the normal mode, it is set that the front end of the medium does not pass through the position of the third medium sensor 115 by a first slip time elapses after the start of feeding of the medium. On the other hand, as the determination criterion for the slip of the medium in the high-speed mode, it is set that the front end of the medium does not pass through the position of the third medium sensor 115 by a second slip time shorter than the first slip time has elapses since the start of feeding of the medium. The first slip time and the second slip time are preset based on a time elapsed from the start of feeding of the medium to the front end of the medium passes through the position of the third medium sensor 115 in an experiment in which various types of media are conveyed. In general, as the size of the medium is larger, the ability of the conveyance is lower, and the time for conveying the medium is longer. The medium conveying apparatus 100 can suppress erroneous determination that the slip has occurred by setting the determination criterion for the slip of the medium in the normal mode, which is set at the time of conveying the medium having a large size so that it is difficult to be determined that the slip has occurred.

For the determination criterion for the multi-feed of the medium, the same criterion is set in the high-speed mode and the normal mode. For example, as the determination criterion for the multi-feed of the medium, it is set that the signal value of the ultrasonic signal is less than a first multi-feed threshold. For the determination criterion for the multi-feed of the medium, a different criterion may be set in the high-speed mode and the normal mode. In this case, the above-described criterion is set as the determination criterion for the multi-feed of the medium in the normal mode. On the other hand, as the determination criterion for the multi-feed of the medium in the high-speed mode, it is set that the signal value of the ultrasonic signal is less than a second multi-feed threshold larger than the first multi-feed threshold. The first multi-feed threshold and the second multi-feed threshold are set to a value between a signal value of an ultrasonic signal when a sheet of paper is conveyed and a signal value of an ultrasonic signal when a multi-feed of paper has occurred.

For the determination criterion for the skew of the medium, the same criterion is also set in the high-speed mode and the normal mode. For example, as the determination criterion for the skew of the medium, it is set that the central portion of the front end of the medium has not reached the position of the fourth medium sensor 120 when a first skew time has elapsed since either end of the front end of the medium reached the imaging position. For the determination criterion for the skew of the medium, a different criterion may be set in the high-speed mode and the normal mode. In this case, the above-described criterion is set as the determination criterion for the skew of the medium in the normal mode. On the other hand, as the determination criterion for the skew of the medium in the high-speed mode, it is set that the central portion of the front end of the medium has not reached the position of the fourth medium sensor 120 when a second skew time shorter than the first skew time has elapsed since either end of the front end of the medium reached the imaging position. The first skew time and the second skew time are preset based on the a elapsed from when the front end of the medium passes through the position of the imaging device 121 to when it passes through the position of the fourth medium sensor 120 in an experiment in which various types of media are conveyed.

As the determination criterion for the skew of the medium, it may be set that the difference in the time at which each of the plurality of portions of the front end of the medium has reached the imaging position is equal to or more than each skew time. Further, a plurality of optical sensors may be located apart from each other along in the width direction A2 in the conveyance path of the medium conveying apparatus 100, and as the determination criterion for the skew of the medium, it is set that the difference in time at which the front end of the medium has reached the position of each optical sensor is equal to or more than each skew time.

Thus, the control module 161 sets the conveyance mode according to the position at which the side guide 107 is located, which is detected by the side guide detection module 162. That is, the control module 161 controls the conveying mechanism so as to change the conveyance speed, the conveyance interval or the ejection speed of the medium to be conveyed first among media placed on the medium tray 103, or changes the determination criterion for the conveyance abnormality of the medium by the determination module 163, according to the position at which the side guide 107 is located, which is detected by the side guide detection module 162. Normally, since the side guides 107 are set to regulate the width direction of the medium, the size of the conveyed medium is likely to be the same as the distance between the two side guides 107. The control module 161 can convey the medium in the conveyance mode suitable for the conveyed medium, by setting the conveyance mode according to the position at which the side guide 107 is located. As a result, the control module 161 can convey the medium satisfactorily.

The control module 161 may set at least one of the conveyance speed of the medium, the conveyance interval of the medium, the ejection speed of the medium, and the determination criterion for the conveyance abnormality of the medium among the parameters of the conveyance mode. Further, the control module 161 may notify the user the set mode, by displaying it on the display device 106. Thus, the user can recognize the currently set mode, the medium conveying apparatus 100 can improve the convenience of the user.

Next, the control module 161 drives the motor 141 and rotates the feed roller 113, the brake roller 114, and the first to fourth conveyance rollers 118, 119, 122 and 123 to convey the medium (step S105). The control module 161 drives the motor 141 to rotate the feed roller 113 and the first to fourth conveyance rollers 118, 119, 122 and 123 in the direction (a medium feeding direction or a medium conveying direction) of the arrows A4, A6, A7, A8 and A9, respectively. Further, the control module 161 drives the motor 141 to rotate the brake roller 114 in the direction of the arrow A5 (the direction opposite to the medium feeding direction). The control module 161 controls the motor 141 so that the medium is conveyed according to the set conveyance mode.

Next, the control module 161 sets the jam flag, the slip flag, the multi-feed flag and the skew flag to OFF (step S106). The jam flag is set to ON when the determination module 163 determines that the jam of the medium has occurred in a jam determination process to be described later. The slip flag is set to ON when the determination module 163 determines that the slip of the medium has occurred in a slip determination process to be described later. The multi-feed flag is set to ON when the determination module 163 determines that the multi-feed of the medium has occurred in a multi-feed determination process to be described later. The skew flag is set to ON when the determination module 163 determines that the skew of the medium has occurred in a skew determination process to be described later.

Next, the determination module 163 determines whether or not any flag among the jam flag, the slip flag, the multi-feed flag and the skew flag is ON (step S107).

When any flag among the jam flag, the slip flag, the multi-feed flag and the skew flag is ON, the determination module 163 determines that the conveyance abnormality of the medium has occurred (step S108).

Next, the control module 161 stops the motor 141 to stop feeding and conveying the medium (step S109). The control module 161 can suppress the medium from being damaged by stopping feeding and conveying the medium when the conveyance abnormality of the medium has occurred. Further, the control module 161 notifies the user of a warning by displaying information indicating that an abnormality has occurred on the display device 106 or transmitting the information to the information processing device via the interface device 142.

Next, the control module 161 drives the motor 141 to rotate the feed roller 113 and the first to fourth conveyance rollers 118, 119, 122 and 123 in the opposite direction of the arrows A4, A6, A7, A8 and A9 (the medium feeding direction or the medium conveying direction), respectively. Further, the control module 161 drives the motor 141 to rotate the brake roller 114 in the direction of the arrow A5 (the direction opposite to the medium feeding direction). Thus, the control module 161 conveys reversely the medium, and once returns the medium to the medium tray 103 (step S110).

Next, the control module 161 resets the counter value (step S111).

Next, the control module 161 resets the conveyance mode to the mode set in the step S104 (step S112). Since the conveyance mode may be changed in the process to be described later, the control module 161 resets the conveyance mode to the first set mode.

Next, the control module 161 re-drives the motor 141 and re-rotates the feed roller 113 and the first to fourth conveyance rollers 118, 119, 122 and 123 in the medium feeding direction or the medium conveying direction to re-feed and re-convey the medium (step S113). Next, the control module 161 returns the process to the step S106.

On the other hand, in step S107, when all the flags of the jam flag, the slip flag, the multi-feed flag and the skew flag are OFF, the control module 161 determines whether or not the entire medium has passed through the imaging position of the imaging device 121 (step S114). The control module 161 acquires the fourth medium signal periodically from the fourth medium sensor 120, and determines whether or not the medium exists at the position of the fourth medium sensor 120, based on the acquired fourth medium signal. The control module 161 determines that the rear end of the medium has passed through the position of the fourth medium sensor 120 when the signal value of the fourth medium signal changes from a value indicating that the medium exists to a value indicating that there is no medium. The control module 161 determines that the entire medium has passed the imaging position when a predetermined time has elapsed after the rear end of the medium has passed through the position of the fourth medium sensor 120. Incidentally, the control module 161 may determine that the entire medium has passed through the imaging position when the control module 151 acquires a predetermined number of line images from the imaging device 121. When the entire medium has not yet passed through the imaging position, the control module 161 returns the process to step S107.

On the other hand, when the entire medium passes through the imaging position, the determination module 163 determines that the conveyance abnormality of the medium has not occurred and the medium has been conveyed successfully (step S115). Thus, the determination module 163 determines whether or not the conveyance abnormality of the medium has occurred.

Next, the control module 161 increments the counter value (+1) (step S116).

Next, the image generation module 164 acquires each line image generated during conveying the medium from the imaging device 121, synthesizes all the acquired line images, to generate the input image acquired by imaging the medium, and transmits the input image to the information processing apparatus via the interface device 142 (step S117).

Next, the control module 161 once stops the motor 141 to once stop feeding and conveying the medium (step S118).

Next, the control module 161 determines whether or not the medium remains on the medium tray 103 based on the second medium signal acquired from the second medium sensor 112 (step S119). When the medium does not remain on the medium tray 103, the control module 161 ends the series of steps.

On the other hand, when the medium remains on the medium tray 103, the size detection module 165 detects the size of the medium included in the input image generated by the image generation module 164 (step S120).

For example, the size detection module 165 performs an edge extraction process on the input image, to extract a pixel in which a difference in gradation values (luminance values or color values) with a peripheral pixel is equal to or more than a predetermined value, or a pixel in which a gradation value is equal to or more than a threshold and a gradation value of the peripheral pixel is less than the threshold, as an edge pixel. Next, the size detection module 165 detects a plurality of straight lines from the extracted edge pixels using the least squares method or the Huff transform. Next, the size detection module 165 detects a rectangle having the largest size among rectangles composed of four straight lines corresponding to the left side, the right side, the upper side and the lower side of the document, respectively, as the medium. Next, the size detection module 165 calculates the size of the detected medium. The size detection module 165 may detect the size of the medium from the input image by utilizing other known image processing techniques, such as pattern matching.

The size detection module 165 may detect the size of the conveyed medium based on the medium signal output from the medium sensor. In that case, a plurality of fourth medium sensors 120 are provided so as to be located apart from each other along in the width direction A2, the size detection module 165 acquires the fourth medium signal periodically from each fourth medium sensor 120. The size detection module 165 detects the size of the conveyed medium in the width direction A2 based on the number of the fourth medium signal of which the signal value indicates that the medium exists. Further, the size detection module 165 detects the size of the conveyed medium in the medium conveying direction A1, based on a period in which the signal value of the fourth medium signal of which the signal value indicates that the medium exists, has indicated that the medium exists.

Next, the control module 161 changes the conveyance mode according to the size of the medium detected by the size detection module 165 (step S121). When the current conveyance mode is the high-speed mode and the size of the detected medium is equal to or more than the A5 size, the control module 161 changes the conveyance mode to the normal mode. On the other hand, when the current conveyance mode is the normal mode and the size of the detected medium is equal to or less than the B6 size, the control module 161 changes the conveyance mode to the high-speed mode.

That is, the control module 161 controls the conveying mechanism so as to change the conveyance speed, the conveyance interval or an ejection speed of the medium to be conveyed thereafter, or changes a determination criterion for the conveyance abnormality of the medium by the determination module 163, according to the detected size of the medium. Some users may not set the side guides 107 to regulate the width direction of the medium, when the conveyance of the medium is performed. In that case, the size of the medium actually conveyed does not match the distance between the two side guides 107. On the other hand, when a plurality of media are conveyed continuously, the size of the plurality of media conveyed continuously is likely to be the same. The control module 161 can increase the possibility of conveying the medium in the conveyance mode suitable for the medium conveyed thereafter, by changing the conveyance mode according to the size of the medium conveyed immediately before. As a result, the control module 161 can convey the medium satisfactorily.

The control module 161 may change at least one of the conveyance speed of the medium, the conveyance interval of the medium, the ejection speed of the medium, and the determination criterion for the abnormal conveyance of the medium among the parameters of the conveyance mode. Further, when the mode is changed, the control module 161 may notify the user that the mode has been changed or the mode after the change, by displaying it on the display device 106. Thus, the user can recognize that the mode has been changed or the mode after the change, the medium conveying apparatus 100 can improve the convenience of the user.

Next, the control module 161 determines whether or not the counter value is equal to or more than a predetermined number (step S122). When the counter value is less than the predetermined number, the control module 161, without performing a particular process, returns the process to step S105.

On the other hand, when the counter value is equal to or more than the predetermined number, the control module 161 changes the conveyance mode so as to increase the conveyance speed of the medium to be conveyed thereafter (sets to a high speed), or reduce the conveyance interval of the medium to be conveyed thereafter (step S123).

Thus, the control module 161 control the conveying mechanism so as to increase the conveyance speed of the medium to be conveyed thereafter, or reduce the conveyance interval of the medium to be conveyed thereafter if the conveyance abnormality of the medium has not occurred when the predetermined number of medium is conveyed. Thus, the control module 161 can reduce the time required for conveying each medium under a condition in which the conveyance abnormality of the medium does not occur, and thus, can reduce the total time of the medium reading process.

The control module 161 may change at least one of the conveyance speed and the conveyance interval of the medium. Further, when the conveyance speed or the conveyance interval of the medium is changed, the control module 161 may notify the user that the conveyance speed or the conveyance interval has been changed, or the conveyance speed or the conveyance interval after the change, by displaying it on the display device 106. Thus, the user can recognize that the conveyance speed or the conveyance interval has been changed or the conveyance speed or the conveyance interval after the change, the medium conveying apparatus 100 can improve the convenience of the user.

Next, the control module 161 changes the determination criterion for the conveyance abnormality of the medium by the determination module 163 so as to be easily determined that the conveyance abnormality of the medium has occurred (step S124), and returns the process to step S105. For example, the control module 161 sets, as the determination criterion for the jam of the medium, that the state in which the arm 111*a* does not exist at the initial position continues for a jam time, which is shorter than the currently set jam time, or longer. Further, the control module 161 sets, as the determination criterion for the slip of the medium, that the front end of the medium has not passed through the position of the third medium sensor 115 until a slip time shorter than the currently set slip time has elapsed, after starting the feeding of the medium.

The control module 161 does not change the determination criterion for multi-feed of the medium and/or the determination criterion for skew. The control module 161 may also change the determination criterion for the multi-feed and/or the determination criterion for the skew. In this case, the control module 161 sets, as the determination criterion for the multi-feed, that the signal value of the ultrasonic signal is less than a multi-feed threshold larger than the currently set multi-feed threshold. Further, the control module 161 sets, as the determination criterion for the skew, that the central portion of the front end of the medium has not reached the position of the fourth medium sensor 120 when a skew time shorter than the currently set skew time has elapsed, after either end of the front end of the medium reaches the imaging position.

Thus, the control module 161 changes the determination criterion by the determination module so as to be easily determined that the conveyance abnormality of the medium has occurred by the determination module 163 when it controls the conveying mechanism so as to increase the conveyance speed of the medium or reduce the conveyance interval of the medium. Thus, the control module 161 can stop the conveyance of the medium earlier, to prevent the occurrence of damage to the medium, even when the conveyance abnormality of the medium has occurred, by reducing time required for the conveying process of the medium too much.

The control module 161 may be set, as the conveyance mode, any of the three or more modes, rather than any of the two modes of the normal mode and the high-speed mode. In this case, each mode is also set corresponding to the position at which the side guide 107 is located and/or the size of the medium. In the medium conveying apparatus 100, a plurality of the first side guide sensor 108 and a plurality of the second side guide sensor 109 are provided, the side guide detection module 162 determines whether the positions at which the side guides 107 are located is included in any of the three or more position ranges. The control module 161 sets the conveyance mode to a mode corresponding to the determined position range. The size detection module 165 determines whether the size of the medium is included in any of the three or more size ranges. The control module 161 changes the conveyance mode to a mode corresponding to the determined size range.

Further, the process of the step S103 may be omitted, and in step S104, the control module 161 may set the conveyance mode based on other information, rather than the position at which the side guide 107 is located. For example, the control module 161 receives the setting of the mode from the user, using the operation device 105 or from an information processing apparatus (not shown) via the interface device 142, and stores it in the storage device 150. In step S104, the control module 161 sets the mode stored in the storage device 150 as the conveyance mode. Alternatively, the control module 161 may store the conveyance result (the number of times or the ratio of the occurrence of the conveyance abnormality of the medium) in the medium reading process of the previous predetermined period, in the storage device 150, and, in step S104, set the conveyance mode based on the conveyance result stored in the storage device 150. Alternatively, the control module 161 may set a predetermined fixed mode as the conveyance mode in step S104. Further, the processes of steps S120 and S121 may be omitted, and the control module 161 may not change the conveyance mode.

Further, the processes of steps S109 to S110, and S112 to S113 are omitted, and the control module 161 may only notify the warning to the user without stopping feeding and conveying the medium when the conveyance abnormality of the medium has occurred. Further, the processes of steps S110 to S113 may be omitted, and the control module 161 may end the series of steps without re-feeding the medium when the control module 151 stops feeding and conveying the medium.

Figure 9:
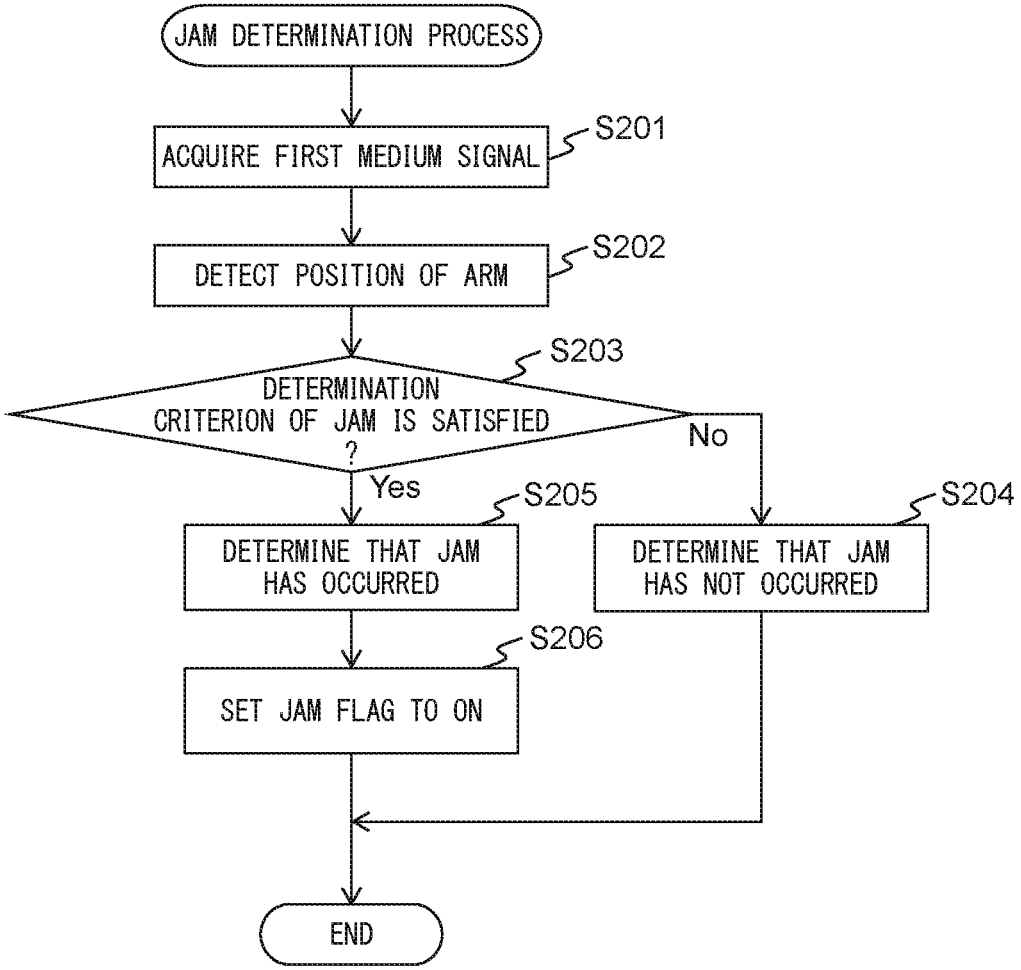
FIG. 9 is a flowchart showing an operation example of a jam determination process.

FIG. 9 is a flowchart illustrating an operation example of the jam determination process in the medium conveying apparatus 100.

Referring to the flowchart illustrated in FIG. 9, the operation example of the jam determination process in the medium conveying apparatus 100 will be described below. The operation flow described below is executed mainly by the processing circuit 160 in cooperation with each element in the medium conveying apparatus 100, in accordance with a program previously stored in the storage device 150. The flow of the operation illustrated in FIG. 9 is periodically executed during medium conveyance.

First, the determination module 163 acquires the first medium signal from the first medium sensor 111 (step S201). Next, the determination module 163 detects the position of the arm 111*a* based on the first medium signal (step S202). Next, the determination module 163 determines whether or not the currently set determination criterion for the jam of the medium is satisfied (step S203). When the determination criterion for the jam of the medium is not satisfied, the determination module 163 determines that the jam of the medium has not occurred (step S204), and ends the series of steps. On the other hand, when the determination criterion for the jam of the medium is satisfied, the determination module 163 determines that the conveyed medium bends and the jam of the medium has occurred (step S205). Next, the determination module 163 sets the jam flag to ON (step S206), and ends the series of steps.

Thus, the determination module 163 determines whether or not the jam of the medium, as the conveyance abnormality of the medium, has occurred, based on the output signal from the first medium sensor 111.

Figure 10:
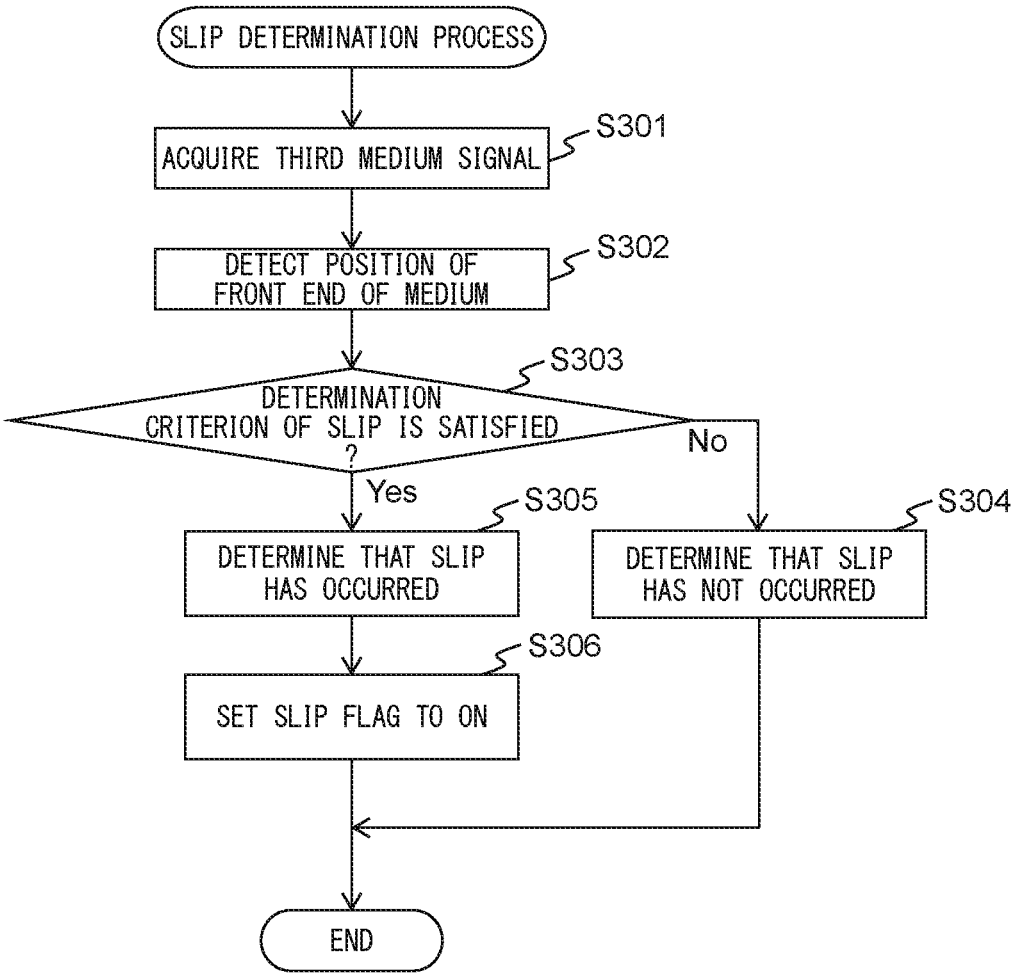
FIG. 10 is a flowchart showing an operation example of a slip determination process.

FIG. 10 is a flowchart illustrating an operation example of the slip determination process in the medium conveying apparatus 100.

Referring to the flowchart illustrated in FIG. 10, the operation example of the slip determination process in the medium conveying apparatus 100 will be described below. The operation flow described below is executed mainly by the processing circuit 160 in cooperation with each element in the medium conveying apparatus 100, in accordance with a program previously stored in the storage device 150. The flow of the operation illustrated in FIG. 10 is periodically executed during medium conveyance.

First, the determination module 163 acquires the third medium signal from the third medium sensor 115 (step S301). Next, the determination module 163 detects the position of the front end of the medium based on the third medium signal (step S302). The determination module 163 determines that the front end of the medium has reached the position of the third medium sensor 115 when the signal value of the periodically acquired third medium signal changes from a value indicating that a medium does not exist to a value indicating that a medium exists. Next, the determination module 163 determines whether or not the currently set determination criterion for the slip is satisfied (step S303). When the determination criterion for the slip of the medium is not satisfied, the determination module 163 determines that the slip of the medium has not occurred (step S304), and ends the series of steps. On the other hand, when the determination criterion for the slip of the medium is satisfied, the determination module 163 determines that the feed roller 113 cannot sufficiently grasp the medium, and the slip of the medium has occurred (step S305). Next, the determination module 163 sets the slip flag to ON (step S306), and ends the series of steps.

The control module 161 may drive the motor 141 so as to rotate the feed roller 113 by a predetermined amount. The predetermined amount is set an amount by which the front end of the medium is fed from the position of the feed roller 113 to the positions of the first and second conveyance rollers 118 and 119. In that case, the control module 161 acquires the third medium signal from the third medium sensor 115 after driving the motor 141 so as to rotate the feed roller 113 by the predetermined amount, and determines whether or not the front end of the medium has reached the position of the third medium sensor 115, based on the third medium signal. When the front end of the medium has not reached the position of the third medium sensor 115, the control module 161 re-drives the motor 141 to rotate the feed roller 113 by the predetermined amount.

In this case, as the determination criterion for the slip of the medium in the normal mode, it is set that the front end of the medium has not passed through the position of the third medium sensor 115 even when the control module 161 re-drives the motor 141 by a first slip number. On the other hand, as the determination criterion for the slip of the medium in the high-speed mode, it is set that the front end of the medium has passed through the position of the third medium sensor 115 even when the control module 161 re-drives the motor 141 by a second slip number smaller than the first slip number.

Thus, the determination module 163 determines whether or not the slip of the medium, as the conveyance abnormality of the medium, has occurred, based on the output signal from the third medium sensor 115.

Figure 11:
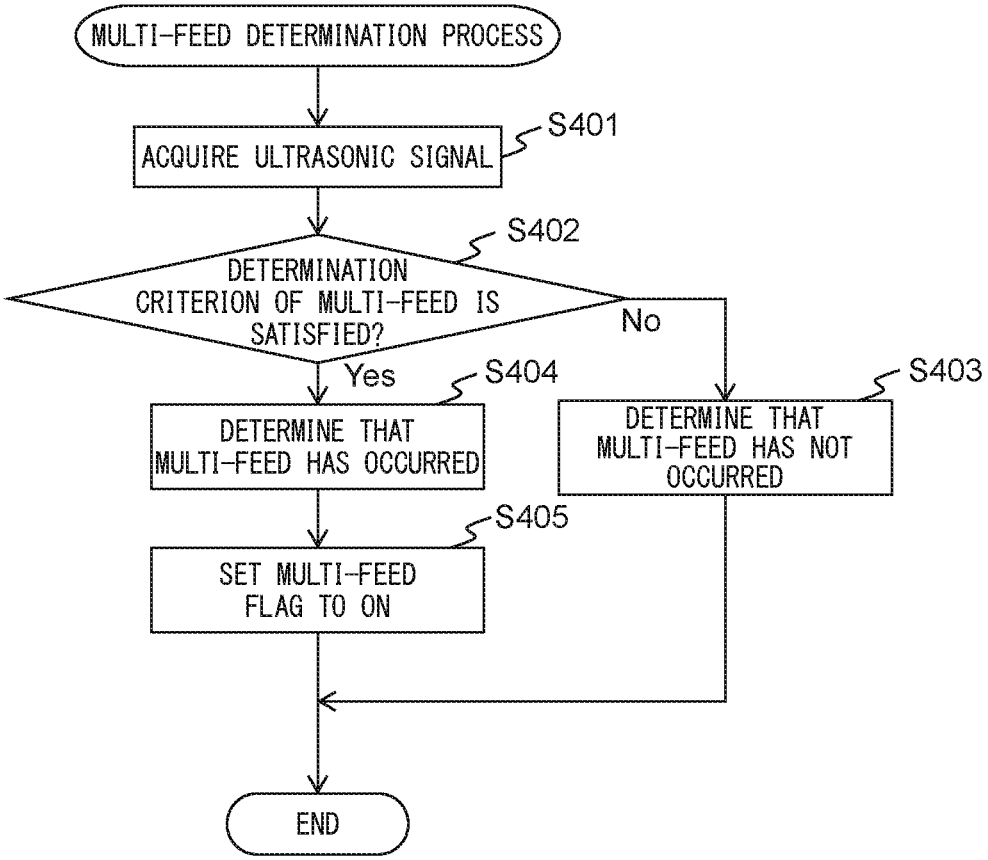
FIG. 11 is a flowchart illustrating an operation example of a multi-feed determination process.

FIG. 11 is a flowchart illustrating an operation example of the multi-feed determination process in the medium conveying apparatus 100.

Referring to the flowchart illustrated in FIG. 11, the operation example of the multi-feed determination process in the medium conveying apparatus 100 will be described below. The operation flow described below is executed mainly by the processing circuit 160 in cooperation with each element in the medium conveying apparatus 100, in accordance with a program previously stored in the storage device 150. The flow of the operation illustrated in FIG. 11 is periodically executed during medium conveyance.

First, the determination module 163 acquires the ultrasonic signal from the ultrasonic sensor 117 (step S401). Next, the determination module 163 determines whether or not the currently set determination criterion for multi-feed of the medium is satisfied (step S402). When the determination criterion for the multi-feed of the medium is not satisfied, the determination module 163 determines that the multi-feed of the medium has not occurred (step S403), and ends the series of steps. On the other hand, when the determination criterion for the multi-feed of the medium is satisfied, the determination module 163 determines that the multi-feed of the medium has occurred (step S404). Next, the determination module 163 sets the multi-feed flag to ON (step S405), and ends the series of steps.

Thus, the determination module 163 determines whether or not the multi-feed of the medium has occurred, as the conveyance abnormality of the medium, based on the output signal from the ultrasonic sensor 117.

Figure 12:
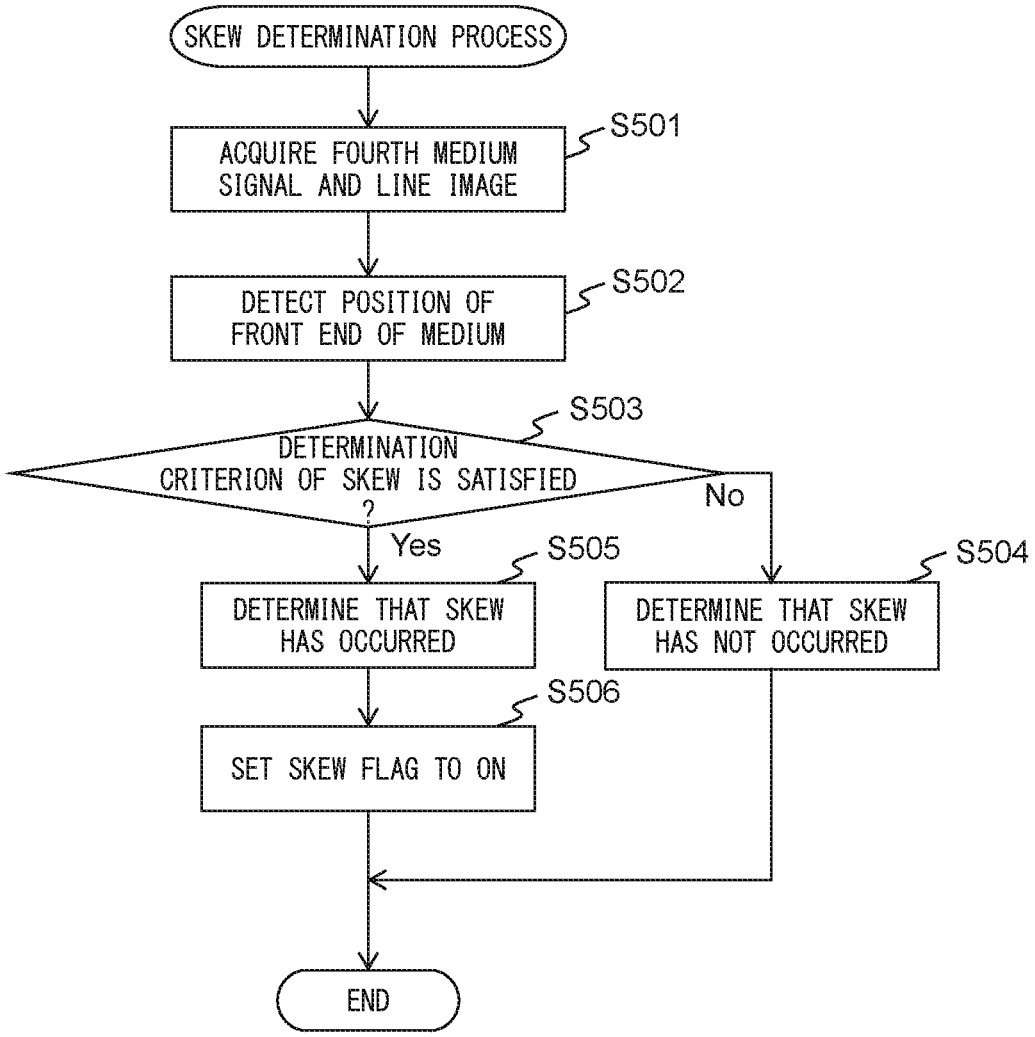
FIG. 12 is a flowchart illustrating an operation example of a skew determination process.

FIG. 12 is a flowchart illustrating an operation example of the skew determination process in the medium conveying apparatus 100.

Referring to the flowchart illustrated in FIG. 12, the operation example of the skew determination process in the medium conveying apparatus 100 will be described below. The operation flow described below is executed mainly by the processing circuit 160 in cooperation with each element in the medium conveying apparatus 100, in accordance with a program previously stored in the storage device 150. The flow of the operation illustrated in FIG. 12 is periodically executed during medium conveyance.

First, the determination module 163 acquires the fourth medium signal from the fourth medium sensor 120, and acquires the line image from the imaging device 121 (step S501). The determination module 163, each time the imaging device 121 generates the line image, acquires the line image from the imaging device 121.

Next, the determination module 163 detects the position of the front end of the medium, based on the fourth medium signal and the line image (step S502). The determination module 163 determines that the central portion of the front end of the medium has reached the position of the fourth medium sensor 120 when the signal value of the periodically acquired fourth medium signal changes from a value indicating that a medium does not exist to a value indicating that a medium exists. The determination module 163 calculates an average value of gradation values of pixels in each end region in a predetermined range from both ends of the line image for each of the latest line image and the line image acquired immediately before. The determination module 163 determines that each end of the front edge of the medium has reached the imaging position when the absolute value of the difference between the average value calculated from each end region of the latest line image and the average value calculated from each end region of the line image acquired immediately before is equal to or more than a gradation threshold value. On the other hand, the determination module 163 determines that each end portion of the front edge of the medium has not yet reached the imaging position when the absolute value of the difference is less than the gradation threshold value. The gradation value is a luminance value or a color value (R value, G value or B value). The gradation threshold is set to, for example, the difference (e.g., 20) of the gradation values that a person can visually determine the difference in luminance or color on the image.

Next, the determination module 163 determines whether or not the currently set determination criterion for the skew of the medium is satisfied (step S503). When the determination criterion for the skew of the medium is not satisfied, the determination module 163 determines that the skew of the medium has not occurred (step S504), and ends the series of steps. On the other hand, when the determination criterion for the skew of the medium is satisfied, the determination module 163 determines that the skew of the medium has occurred (step S505). Next, the determination module 163 sets the skew flag to ON (step S506), and ends the series of steps.

Thus, the determination module 163 determines whether or not the skew of the medium has occurred, as the conveyance abnormality of the medium, based on the output image from the imaging device 121 and/or the output signal from the fourth medium sensor 120.

The determination module 163 may determine whether or not at least one of the jam, the slip, the multi-feed and the skew of the medium has occurred, as the conveyance abnormality of the medium.

As described in detail above, if the conveyance abnormality of the medium has not occurred when a predetermined number of media are conveyed, i.e., if a predetermined number of media are stably conveyed, the medium conveying apparatus 100 increases the conveyance speed of the medium to be conveyed thereafter or reduces the conveyance interval of the medium to be conveyed thereafter. Thus, the medium conveying apparatus 100 can further reduce the time required for conveying the medium while suppressing the occurrence of the conveyance abnormality of the medium.

In particular, the medium conveying apparatus 100 can reduce the time required for conveying the medium while suppressing the occurrence of the conveyance abnormality of the medium, regardless of the state of the medium, for a plurality of media having different sizes from each other, a medium having a damage such as a breakage or a chipping, etc., or a medium having a dirt. Since the user does not need to change the conveyance mode according to the conveyed medium, the medium conveying apparatus 100 can reduce the load of the user and improve the convenience of the user.

Figure 13:
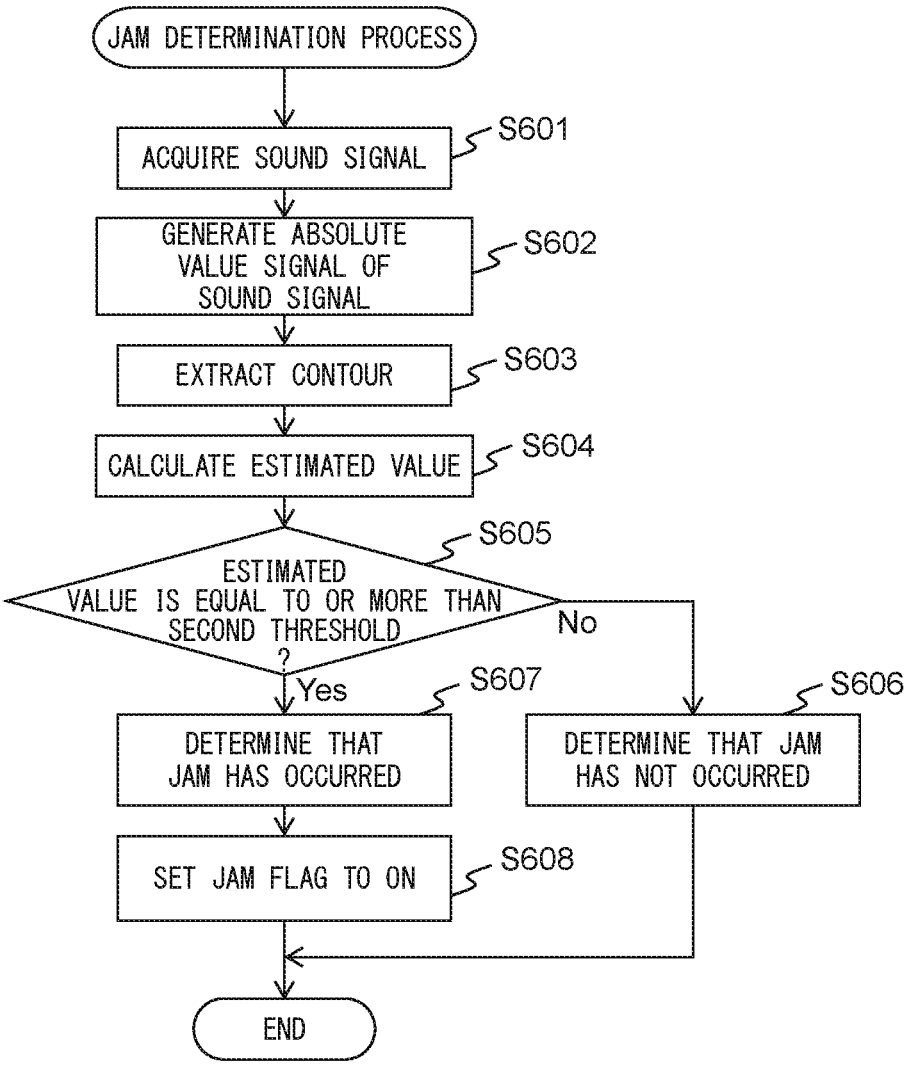
FIG. 13 is a flowchart illustrating another operation example of the jam determination process.

FIG. 13 is a flowchart illustrating another example of the operation of the jam determination process in the medium conveying apparatus 100. The flowchart shown in FIG. 13 is executed instead of the flowchart shown in FIG. 9 or in addition to the flowchart shown in FIG. 9.

When the flow chart shown in FIG. 13 is executed, in step S104 of FIG. 7 and step S121 of FIG. 8, as the determination criterion for the jam of the medium in the normal mode, it is set that the jam of the medium is determined to have occurred using a first parameter group. On the other hand, as the determination criterion for the jam of the medium in the high-speed mode, it is set that the jam of the medium is determined to have occurred using a second parameter group. The first parameter group and the second parameter group include a first threshold, a second threshold, an addition point and a subtraction point. The first threshold is compared with a signal value of the sound signal. The second threshold is compared with an estimated value calculated based on the number of times the signal value of the sound signal is equal to or more than the first threshold. The addition point is added to the estimated value when the signal value of the sound signal is equal to or more than the first threshold. The subtraction point is subtracted from the estimated value when the signal value of the sound signal is less than the first threshold.

The second parameter group is set so that it is easy to be determined that the jam of the medium has occurred, as compared with the first parameter group. The first threshold, the second threshold and the subtraction point included in the second parameter group is set to a value smaller than the first threshold, the second threshold and the subtraction point included in the first parameter group, respectively. On the other hand, the addition point included in the second parameter group is set to a value larger than the addition point included in the first parameter group.

Further, in step S124 of FIG. 8, the control module 161 sets the first threshold, the second threshold and the subtraction point, to a value smaller than the first threshold, the second threshold and the subtraction point which are currently set, and sets the addition point to a value larger than the addition point which is currently set.

First, the determination module 163 acquires the sound signal from the sound signal generation circuit 130 (step S601).

Figure 14A:
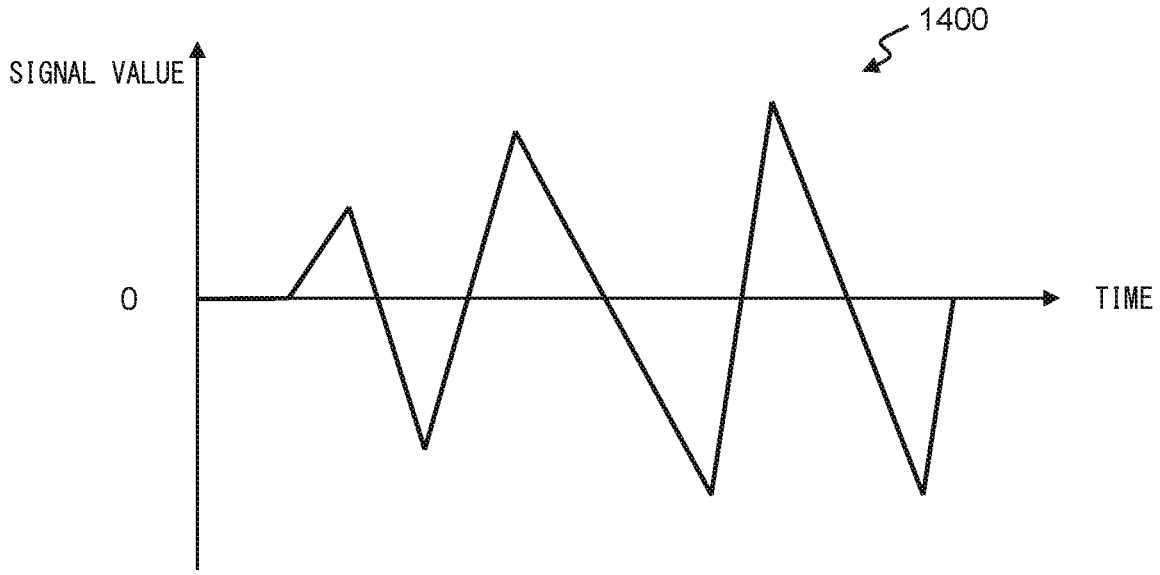
FIG. 14A shows an example of a sound signal.

FIG. 14A is a graph showing an example of the sound signal. The graph 1400 in FIG. 14A shows a sound signal output from the sound signal generation circuit 130. The horizontal axis of the graph 1400 indicates time, and the vertical axis indicates the signal value.

Next, the determination module 163 generates an absolute value signal of the sound signal output from the sound signal generation circuit 130 (step S602).

Figure 14B:
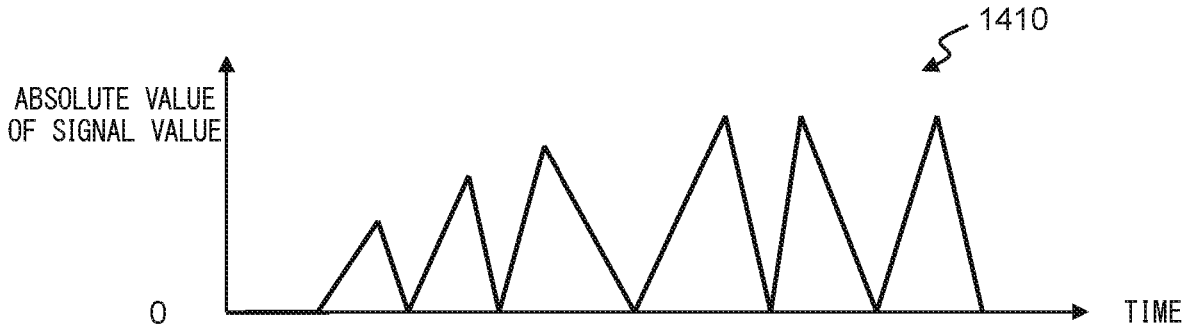
FIG. 14B is a graph showing an example of an absolute signal of the sound signal.

FIG. 14B is a graph showing an example of the absolute value signal of the sound signal. The graph 1410 in FIG. 14B shows an absolute value signal of the sound signal of the graph 1400. The horizontal axis of the graph 1410 indicates time, and the vertical axis indicates the absolute value of the signal value.

Next, the determination module 163 extracts the contour of the absolute value signal of the sound signal to generate a contour signal (step S603). As the contour signal, the determination module 163 extracts an envelope.

Figure 14C:
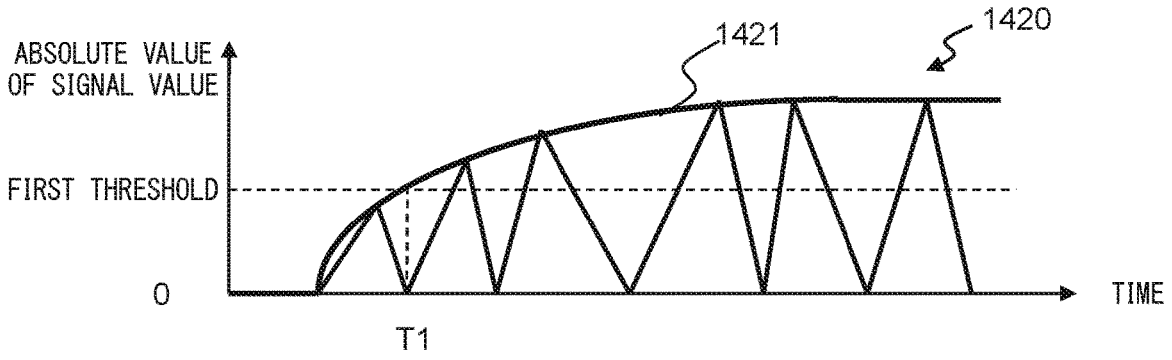
FIG. 14C is a graph showing an example of a contour signal.

FIG. 14C is a graph showing an example of the contour signal. The graph 1420 in FIG. 14C shows an envelope 1421 of the absolute value signal of the sound signal of the graph 1410. The horizontal axis of the graph 1420 indicates time, and the vertical axis indicates the absolute value of the signal value.

Next, the determination module 163 calculates an estimated value, based on the contour signal (step S604). The determination module 163 calculates the estimated value so that it increases when the value of the contour signal is not less than the first threshold and that it decreases when the signal value is less than the first threshold. The determination module 163 determines whether the value of the envelope 1221 is not less than the first threshold, at predetermined intervals (e.g., at sampling intervals of analog-to-digital conversion). When the value of the envelope 1221 is not less than the first threshold, the determination module 163 adds the addition point to the estimated value; when it is less than the first threshold, it subtracts the subtraction point from the estimated value.

Figure 14D:
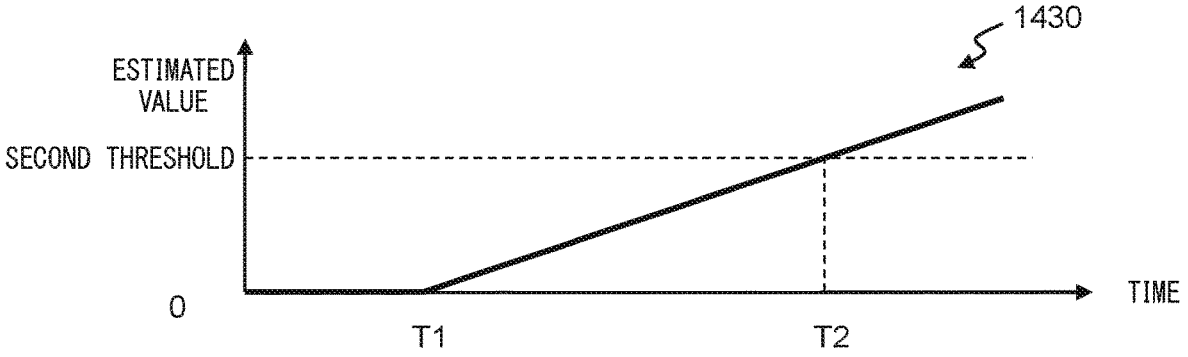
FIG. 14D is a graph showing an example of an estimated value.

FIG. 14D is a graph showing an example of the estimated value. The graph 1430 in FIG. 14D shows an estimate calculated for the envelope 1421 of the graph 1420. The horizontal axis of the graph 1420 indicates time, and the vertical axis indicates the counter value.

Next, the determination module 163 determines whether or not the estimated value is equal to or more than the second threshold (step S605). The determination module 163 determines that the jam of the medium has not occurred when the estimated value is less than the second threshold (step S606), and ends the series of steps. On the other hand, the determination module 163 determines that the jam of the medium has occurred when the estimated value is equal to or more than the second threshold (step S607). Next, the determination module 163 sets the jam flag to ON (step S608), and ends the series of steps.

In FIG. 14C, the envelope 1421 exceeds the first threshold at time T1, and is thereafter kept more than the first threshold. Therefore, the estimated value increases from time T1 and exceeds the second threshold at time T2, as shown in FIG. 14D; and the determination module 163 then determines that the conveyance abnormality of the medium has occurred.

Thus, the determination module 163 determines whether or not the jam of the medium, as the conveyance abnormality of the medium, has occurred, based on the sound signal from the sound signal generation circuit 130. In particular, the determination module 163 adds the addition point or subtracts the subtraction point, based on a comparison between a sound signal and the first threshold, to calculate an estimated value, and determines whether or not the conveyance abnormality of the medium has occurred, based on a comparison between the estimated value and the second threshold.

In step S603, the determination module 163 may acquire a signal by executing peak hold on the absolute value signal of the sound signal at predetermined intervals as the contour signal, instead of an envelope. Further, the determination module 163 may acquire a signal by applying a known smoothing filter, averaging filter, or low-pass filter to the absolute value signal of the sound signal as the contour signal.

As described in detail above, the medium conveying apparatus 100 can reduce the time required for conveying the medium while suppressing the occurrence of the conveyance abnormality of the medium, even when the medium conveying apparatus 100 determines whether or not the jam of the medium has occurred by sound.

Figure 15:
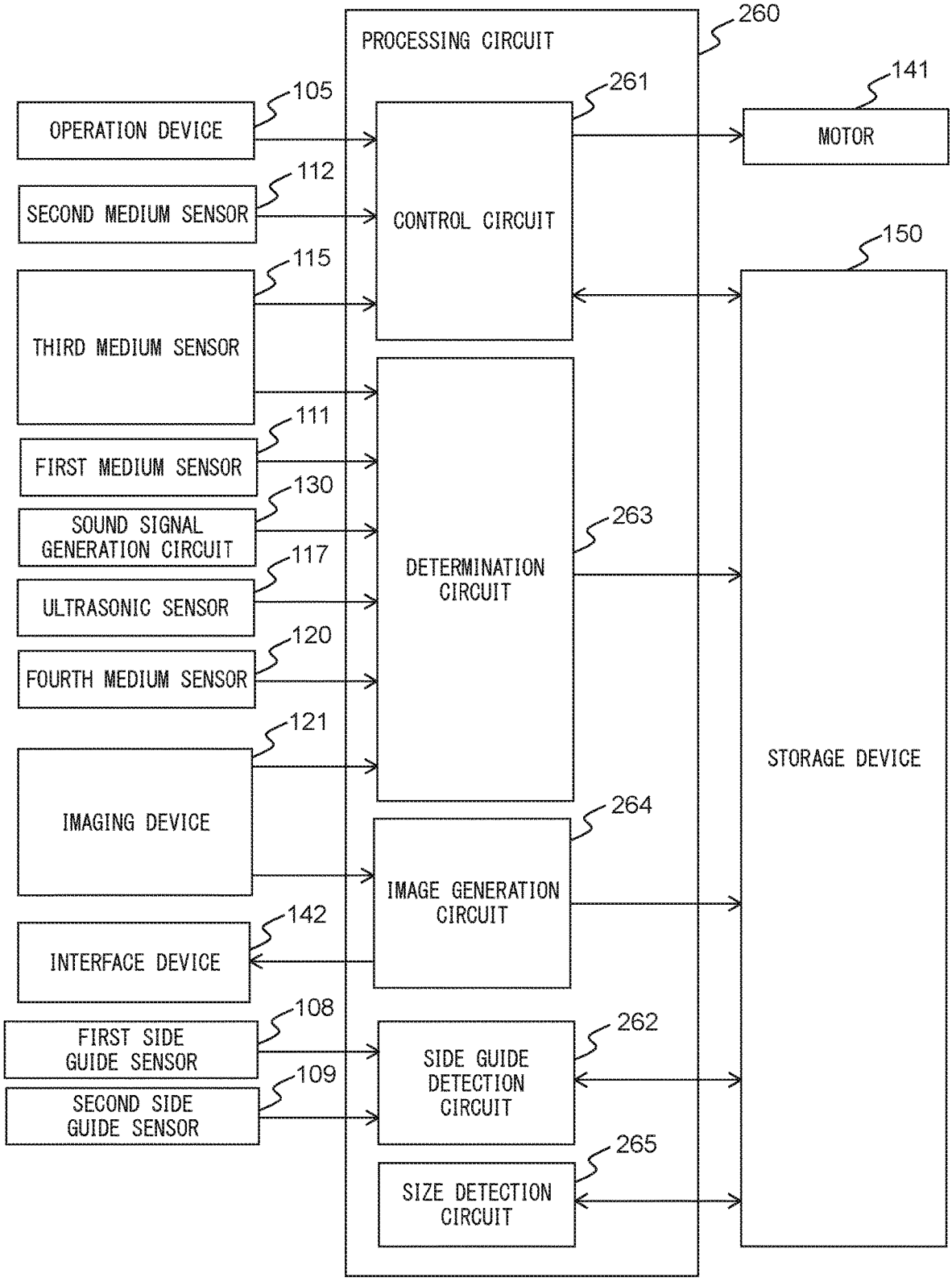
FIG. 15 is a diagram illustrating a schematic configuration of another processing circuit 260.

FIG. 15 is a diagram illustrating a schematic configuration of a processing circuit 260 in a medium conveying apparatus according to another embodiment. The processing circuit 260 is used in place of the processing circuit 160 in the medium conveying apparatus 100 and executes the medium read process, the jam determination process, the slip determination process, the multi-feed determination process and the skew determination process in place of the processing circuit 160. The processing circuit 260 includes a control circuit 261, a side guide detection circuit 262, a determination circuit 263, an image generation circuit 264 and a size detection circuit 265, etc. Note that each unit may be configured by an independent integrated circuit, a microprocessor, firmware, etc.

The control circuit 261 is an example of a control module, and has a function similar to the control module 161. The control circuit 261 reads out the jam flag, the slip flag, the multi-feed flag, the skew flag, the position at which the side guide is located, the size of the medium and the determination result of the conveyance abnormality of the medium, etc., from the storage device 150. The control circuit 261 sets or changes the conveyance mode according to the read information and stores it in the storage device 150. Further, the control circuit 261 receives the operation signal from the operation device 105, the second medium signal from the second medium sensor 112, and the third medium signal from the third medium sensor 115, and reads the determination result of the conveyance abnormality of the medium from the storage device 150. The control circuit 261 outputs a control signal to the motor 141 to control the feeding and the conveying of the medium according to the received respective signals and the read information.

The side guide detection circuit 262 is an example of a side guide detection module, and has a function similar to the side guide detection module 162. The side guide detection circuit 262 receives the first side guide signal from the first side guide sensor 108, the second side guide signal from the second side guide sensor 109, detects the position at which the side guide is located, and stores the detection result in the storage device 150.

The determination circuit 263 is an example of a determination module, and has a functions similar to the determination module 163. The determination circuit 263 receives the first medium signal from the first medium sensor 111, or receives the sound signal from the sound signal generation circuit 130. The determination circuit 263 receives the third medium signal from the third medium sensor 115, the fourth medium signal from the fourth medium sensor 120, the line image from the imaging device 121, and the ultrasonic signal from the ultrasonic sensor 117. The determination circuit 263 determines whether or not the conveyance abnormality of the medium has occurred based on the received respective signals or images, and stores the determination result in the storage device 150.

The image generation circuit 264 is an example of an image generating module, and has a functions similar to the image generating module 164. The image generation circuit 264 receives line images from the imaging device 121 to generate the input image, stores it in the storage device 150, and transmits it to the information processing apparatus via the interface device 142.

The size detection circuit 265 is an example of a size detection module, and has a function similar to the size detection module 165. The size detection circuit 265 reads the input image from the storage device 150, detects the size of the medium, and stores it in the storage device 150.

As described in detail above, the medium conveying apparatus can further reduce the time required for conveying the medium while suppressing the occurrence of the conveyance abnormality of the medium, even when using the processing circuit 260.

REFERENCE SIGNS LIST

100 medium conveying apparatus
103 medium tray
113 feed roller
114 brake roller
118 first conveyance roller
119 second conveyance roller
122 third conveyance roller
123 fourth conveyance roller
161 control module
162 side guide detection module
163 determination module
164 image generation module
165 size detection module

What is claimed is:

1. A medium conveying apparatus comprising:
a conveying mechanism to convey a medium; and
a processor to
determine whether a conveyance abnormality of the medium has occurred, and
control the conveying mechanism to increase a conveyance speed of the medium to be conveyed thereafter or reduce a conveyance interval of the medium to be conveyed thereafter, and set the conveyance speed in a state where a size of the medium is a first size to a higher speed than the conveyance speed in a state where the size of the medium is a second size larger than the first size or set the conveyance interval in a state where the size of the medium is the first size to a time shorter than the conveyance interval in a state where the size of the medium is the second size, when the conveyance abnormality of the medium has not occurred for a predetermined plurality of medium that are consecutively conveyed.

2. The medium conveying apparatus according to claim 1, wherein
the processor generates an input image acquired by imaging the medium, and wherein
the processor detects a size of the medium included in the input image, and controls the conveying mechanism to set the conveyance speed in a state where the size of the medium is the first size to a higher speed than the conveyance speed in a state where the size of the medium is the second size or set the conveyance interval in a state where the size of the medium is the first size to a time shorter than the conveyance interval in a state where the size of the medium is the second size.

3. The medium conveying apparatus according to claim 1, further comprising:
a medium tray; and
a side guide to regulate a width direction of the medium, wherein the processor detects a position at which the side guide is located, and controls the conveying mechanism to set the conveyance speed in a state where the position is a first position to a higher speed than the conveyance speed in a state where the position is a second position outside the first position or set the conveyance interval in a state where the position is the first position to a time shorter than the conveyance interval in a state where the position is the second position.

4. The medium conveying apparatus according to claim 1, wherein the processor changes a determination criterion for the conveyance abnormality of the medium to be determined that the conveyance abnormality of the medium has occurred when the processor controls the conveying mechanism to reduce the conveyance interval of the medium.

5. The medium conveying apparatus according to claim 1, wherein the processor determines whether a jam, a slip, a multi-feed or a skew of the medium has occurred as the conveyance abnormality of the medium.

6. A method for conveying a medium, the method comprising:
conveying the medium, by a conveying mechanism;
determining whether a conveyance abnormality of the medium has occurred; and controlling the conveying mechanism to increase a conveyance speed of the medium to be conveyed thereafter or reduce a conveyance interval of the medium to be conveyed thereafter, and set the conveyance speed in a state where a size of the medium is a first size to a higher speed than the conveyance speed in a state where the size of the medium is a second size larger than the first size or set the conveyance interval in a state where the size of the medium is the first size to a time shorter than the conveyance interval in a state where the size of the medium is the second size, when the conveyance abnormality of the medium has not occurred for a predetermined plurality media that are consecutively conveyed.

7. The method according to claim 6, further comprising:

generating an input image acquired by imaging the medium; and detecting a size of the medium included in the input image, wherein the conveying mechanism is controlled so that the conveyance speed in a state where the size of the medium is the first size is set to a higher speed than the conveyance speed in a state where the size of the medium is the second size or the conveyance interval in a state where the size of the medium is the first size is set to a time shorter than the conveyance interval in a state where the size of the medium is the second size.

8. The method according to claim 6, further comprising:

regulating a width direction of the medium, by a side guide; and detecting a position at which the side guide is located, wherein the conveying mechanism is controlled so that the conveyance speed in a state where the position is a first position is set to a higher speed than the conveyance speed in a state where the position is a second position outside the first position or the conveyance interval in a state where the position is the first position is set to a time shorter than the conveyance interval in a state where the position is the second position.

9. The method according to claim 6, wherein a determination criterion for the conveyance abnormality of the medium is changed to be determined that the conveyance abnormality of the medium has occurred when the conveying mechanism is controlled so that the conveyance interval of the medium is reduced.

10. The method according to claim 6, wherein whether a jam, a slip, a multi-feed or a skew of the medium has occurred is determined, as the conveyance abnormality of the medium.

11. A computer-readable, non-transitory medium storing a computer program, wherein the computer program causes a medium conveying apparatus including a conveying mechanism to convey a medium, to execute a process, the process comprising:

determining whether a conveyance abnormality of the medium has occurred; and controlling the conveying mechanism to increase a conveyance speed of the medium to be conveyed thereafter or reduce a conveyance interval of the medium to be conveyed thereafter, and set the conveyance speed in a state where a size of the medium is a first size to a higher speed than the conveyance speed in a state where the size of the medium is a second size larger than the first size or set the conveyance interval in a state where the size of the medium is the first size to a time shorter than the conveyance interval in a state where the size of the medium is the second size, when the conveyance abnormality of the medium has not occurred for a predetermined plurality media that are consecutively conveyed.

12. The computer-readable, non-transitory medium according to claim 11, the process further comprising:

generating an input image acquired by imaging the medium; and detecting a size of the medium included in the input image, wherein the conveying mechanism is controlled so that the conveyance speed in a state where the size of the medium is the first size is set to a higher speed than the conveyance speed in a state where the size of the medium is the second size or the conveyance interval in a state where the size of the medium is the first size is set to a time shorter than the conveyance interval in a state where the size of the medium is the second size.

13. The computer-readable, non-transitory medium according to claim 11, wherein the medium conveying apparatus further includes a medium tray, and a side guide to regulate a width direction of the medium, and the process further comprising detecting a position at which the side guide is located, wherein the conveying mechanism is controlled so that the conveyance speed in a state where the position is a first position is set to a higher speed than the conveyance speed in a state where the position is a second position outside the first position or the conveyance interval in a state where the position is the first position is set to a time shorter than the conveyance interval in a state where the position is the second position.

14. The computer-readable, non-transitory medium according to claim 11, wherein a determination criterion for the conveyance abnormality of the medium is changed to be determined that the conveyance abnormality of the medium has occurred when the conveying mechanism is controlled so that the conveyance interval of the medium is reduced.

15. The computer-readable, non-transitory medium according to claim 11, wherein whether a jam, a slip, a multi-feed or a skew of the medium has occurred is determined, as the conveyance abnormality of the medium.

* * * * *